United States Patent [19]

Sato et al.

[11] Patent Number: 4,877,720

[45] Date of Patent: Oct. 31, 1989

[54] SILVER HALIDE PHOTOGRAPHIC MATERIAL

[75] Inventors: Kozo Sato; Shigeru Ohno; Sumito Yamada, all of Kanagawa, Japan

[73] Assignee: Fuji Photo Film Co., Ltd., Kanagawa, Japan

[21] Appl. No.: 188,583

[22] Filed: Apr. 29, 1988

[30] Foreign Application Priority Data

Apr. 30, 1987 [JP] Japan ..... 62-106888

[51] Int. Cl.[4] ..... G03C 1/10; G03C 1/34; G03C 1/42

[52] U.S. Cl. ..... 430/512; 430/223; 430/517; 430/542; 430/551; 430/566; 430/598; 430/606; 430/609; 430/627; 430/629; 430/630; 430/955; 430/957; 430/959

[58] Field of Search ..... 430/223, 955, 957, 959, 430/627, 629, 630, 517, 542, 551, 566, 598, 606, 609

[56] References Cited

U.S. PATENT DOCUMENTS

| | | | |
|---|---|---|---|
| 4,450,223 | 5/1984 | Van Poucke et al. | 430/223 |
| 4,499,181 | 2/1985 | Watanabe et al. | 430/223 |
| 4,522,917 | 6/1985 | Ichijima et al. | 430/955 |
| 4,584,263 | 4/1986 | Takahashi | 430/627 |
| 4,609,610 | 9/1986 | Dunlap et al. | 430/223 |
| 4,618,571 | 10/1986 | Ichijima et al. | 430/955 |
| 4,619,884 | 10/1986 | Singer | 430/223 |
| 4,737,451 | 4/1988 | Ichijima | 430/223 |
| 4,783,396 | 11/1988 | Nakamura et al. | 430/353 |
| 4,820,622 | 4/1989 | Hirai | 430/351 |

*Primary Examiner*—Paul R. Michl
*Assistant Examiner*—Hoa Van Le
*Attorney, Agent, or Firm*—Sughrue, Mion, Zinn, Macpeak & Seas

[57] ABSTRACT

A silver halide photographic material comprising a support having thereon at least one silver halide emulsion layer, at least one layer of the silver halide photographic material comprising at least one compound represented by formula (I):

$$\text{PWR}\text{-}(\text{Time})_t\text{-POL} \qquad \text{(I)}$$

wherein PWR represents a group capable of releasing (Time—$_t$POL upon reduction; Time represents a divalent organic group capable of releasing POL via a subsequent reaction after (Time—$_t$POL is released from PWR; t is 0 or 1; and POL represents a polymer group.

The compound represented by formula (I) is a useful functional polymer whose properties are drastically changed upon reduction and reveal photographically useful function.

18 Claims, No Drawings

SILVER HALIDE PHOTOGRAPHIC MATERIAL

FIELD OF THE INVENTION

The present invention relates to a functional polymer useful for a silver halide photographic material, and particularly, to a silver halide photographic material containing a novel polymer whose properties are drastically changed to reveal useful functions upon being reduced in development processing.

BACKGROUND OF THE INVENTION

Various functional polymers are employed in silver halide photographic materials. For instance, antistatic agents, viscosity imparting agents and flocculating agents, etc. are known. Polymers which reveal higher level functions include polymers for a timing layer, polymers for compensation for temperature and polymers for mordanting a dye, each useful in instant photography, etc. as described in detail in U.S. Pat. Nos. 3,958,995, 3,295,970 and 3,706,557, *Photogr. Sci. Eng.*, Vol 20, page 155 (1976), etc. Other photographic functional polymers including polymer couplers as described in U.S. Pat. Nos. 2,739,956, 2,561,205, 2,976,294 and 4,128,427, etc., polymer ultraviolet ray absorbing agents as described in Japanese patent application (OPI) No. 560/72 (the term "OPI" as used herein means an "unexamined published Japanese patent application"), etc., polymer antifogging agents as described in Japanese patent application (OPI) No. 90844/84, etc., and polymer silver salt stabilizers as described in Japanese patent application (OPI) No. 211142/82, etc. are also known, With these polymers, however, their property does not drastically change before and after development processing.

With respect to silver halide photographic materials, high image quality, simple and rapid processing, and fastness of images formed have been strongly desired. Therefore, further high level function is desired in photographic functional polymers.

As advantages of polymerization of low molecular functional compounds it is generally considered to make diffusion resistance, to provide selective reactivity by forming high molecular materials, to stabilize unstable substances, to easily control properties by means of copolymerization, to simplify a dispersing step, etc.

Depending on the functional compounds, it is desired that their function appear or disappear before and after development processing or that their properties, such as solubility, diffusibility, viscosity, etc. drastically change before and after development processing. As low molecular compounds having such function, antifogging agent precursors or development inhibitor precursors as described in Japanese patent publication Nos. 17369/79, 9696/80 and 39727/79, Japanese patent application (OPI) Nos. 135944/82 and 136640/82, etc. and silver halide solvent precursors as described in U.S. Pat. No. 3,932,480, etc. have been already employed or proposed. However, there is little mention of compounds having both advantages based on polymerization and particular functions of low molecular compound, specifically polymers which exhibit or lose functions before and after development processing or polymers with properties that drastically change before and after development processing.

SUMMARY OF THE INVENTION

Therefore, an object of the present invention is to provide a novel highly functional polymer capable of forming a polymer which exhibits a photographically useful function at development processing for the first time.

Another object of the present invention is to provide a novel highly functional polymer in which useful functions are maintained during the production of a photographic light-sensitive material and exposure to light thereof, and is lost at the time of development processing, whereby a photographically useful property is provided.

A further object of the present invention is to provide a silver halide photographic material containing a novel highly functional polymer.

Other objects of the present invention will become apparent from the following description and examples.

It has now been discovered that these and other objects of the present invention can be achieved by a silver halide photographic material comprising a support having thereon at least one silver halide emulsion layer, at least one layer of the silver halide photographic material comprising at least one compound represented by formula (I):

$$\text{PWR}-(\text{Time}_t)-\text{POL} \qquad \text{(I)}$$

wherein PWR are presents a group capable of releasing (Time—$_t$POL upon reduction; Time represents a divalent organic group caapable of releasing POL via a subsequent reaction after (Time—$_t$POL is released from PWR; t is 0 or 1; and POL represents a polymer group.

DETAILED DESCRIPTION OF THE INVENTION

In the compound represented by the general formula (I), it is preferred that the group represented by PWR has a molecular weight of not more than about 1,500.

The group represented by PWR may be any of the group that corresponds to a moiety containing an electron accepting center and an intramolecular nucleophilic substitution center in a compound capable of releasing a photographic reagent through reduction followed by intramolecular nucleophilic substitution as disclosed in U.S. Pat. Nos. 4,139,389, 4,139,379 and 4,564,577 and Japanese patent application (OPI) No. 185333/84 and 84453/82; group that corresponds to a moiety containing an electron accepting quinoid center and a carbon atom connecting the quinoid center to a photographic reagent in a compound capable of releasing a photographic reagent through reduction followed by intramolecular electron transfer as disclosed in U.S. Pat No. 4,233,107, Japanese patent application (OPI) No. 101649/84, *Research Disclosure,* No. 24025, IV (1984), and Japanese patent application (OPI) No. 88257/86; group that corresponds to a moiety containing an aryl group substituted with an electron attractive group and an atom (a sulfur, carbon or nitrogen atom) connecting the substituted aryl group to a photographic reagent in a compound capable of releasing a photographic reagent through reduction followed by cleavage of its single bond as disclosed in West German patent application (OLS) No. 3,008,588, Japanese patent application (OPI) No. 142530/81, and U.S. Pat. Nos. 4,343,893 and 4,619,884; group that corresponds to a moiety containing a nitro group and a carbon atom connecting the nitro group to a photographic reagent in a nitro compound capable of releasing a photographic reagent after electron acceptance as disclosed in U.S. Pat. No. 4,450,223; or group that corresponds to a moiety containing a gem-dinitro group and a carbon atom connecting the dinitro group to a photographic reagent in a dinitro compound capable of $\beta$-releasing a photographic reagent after electron acceptance as disclosed in U.S. Pat. No. 4,609,610.

The groups represented by —(Time)—$_t$ and POL are described below.

Of the compounds represented by formula (I), preferred are those represented by formula (II):

(II)

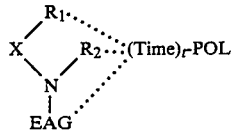

wherein EAG represents an electron accepting group; N represents a nitrogen atom; X represents an oxygen atom (—O—), a sulfur atom (—S—) or an atomic group containing a nitrogen atom

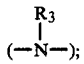

$R_1$, $R_2$ and $R_3$, which may be the same or different, each represents a chemical bond or a group other than a hydrogen atom, or $R_1$, $R_2$, $R_3$ and EAG may be connected with each other to form a ring; Time represents a group capable of releasing POL via a subsequent reaction triggered by the cleavage of the N-X bond in the compound; t represents 0 or 1, when t represent 0, Time represents a chemical bond; the solid lines each represents a bond; the dotted lines mean that at least one of the dotted lines is a bond; and POL and t each has the same meaning as in formula (I).

In formula (II),

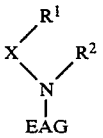

corresponds to PWR of formula (II). (Time)—$_t$POL is bonded to at least one of $R_1$ $R_2$, and EAG.

The group other than a hydrogen atom as represented by $R_1$, $R_2$, and $R_3$ includes a substituted or unsubstituted alkyl or aralkyl group (e.g., methyl, trifluoromethyl, benzyl, chloromethyl, dimethylaminomethyl, ethoxycarbonylmethyl, aminomethyl, acetylmainomethyl, ethyl, 2-(4-dodecanoylaminophenyl-)ethyl, carboxyethyl, allyl, 3,3,3-trichloropropyl, n-propyl, isopropyl, n-butyl, iso-butyl, sec-butyl, t-butyl, n-pentyl, secpentyl, t-pentyl, cyclopentyl, n-hexyl, sec-hexyl, t-hexyl, cyclohexyl, n-octyl, sec-octyl, t-octyl, n-decyl, n-undecyl, n-dodecyl, n-tetradecyl, n-pentadecyl, n-hexadecyl, sec-hexadecyl, t-hexadecyl, n-octadecyl, and t-octadecyl groups), a substituted or unsubstituted alkenyl group (e.g., vinyl, 2-chlorovinyl, 1-methylvinyl, 2-cyanovinyl, and cyclohexen-1-yl groups), a substituted or unsubstituted alkynyl group (e.g., ethynyl, 1-propynyl, and 2-ethoxycarbonylethynyl groups), a substituted or unsubstituted aryl group (e.g., phenyl, naphthyl, 3-hydroxphenyl, 3-chlorophenyl, 4acetylaminophenyl, 4-hexadecanesulfonylaminophenyl, 2-methanesulfonyl-4-nitrophenyl, 3-nitrophenyl, 4-methoxyphenyl, 4-acetylaminophenyl, 4-methanesulfonylphenyl, 2,4-dimethylphenyl, and 4-tetradecyloxyphenyl groups), a substituted or unsubstituted heterocyclic group (e.g., 1-imidazolyl, 2-furyl, 2-pyridyl, 5-nitro-2-pyridyl, 3-pyridyl, 3,5-dicyano-2-pyridyl, 5-tetrazolyl, 5-phenyl-1-tetrazolyl, 2-benzothiazolyl, 2-benzimidazolyl,2-benzoxazolyl, 2-oxazolin-2-yl, and morpholino groups), a substituted or unsubstituted acyl group (e.g., acetyl, propionyl, butyroyl, isobutyroyl, 2,2-dimethylpropionyl, benzoyl, 3,4-dichlorobenzoyl, 2-acetylamino-4-methoxybenzoyl, 4-methylbenzoyl, and 4-methoxy-3-sulfobenzoyl groups), a substituted or unsubstituted sulfonyl group (e.g., methanesulfonyl, ethanesulfonyl, chloromethanesulfonyl, propanesulfonyl, butanesulfonyl, n-octanesulfonyl, n-dodecanesulfonyl, n-hexadecanesulfonyl, benzenesulfonyl, 4-toluenesulfonyl, and 4-n-dodecyloxybenzenesulfonyl groups), a substituted or unsubstituted carbamoyl group (e.g., carbamoyl, methylcarbamoyl, dimethylcarbamoyl, bis-(2-methoxyethyl) carbamoyl, diethylcarbamoyl, cyclohexylcarbamoyl, di-n-octylcarbamoyl, 3-dodecyloxypropylcarbamoyl, hexadecylcarbamoyl, 3-(2,4-di-t-pentylphenoxy)-propylcarbamoyl, 3-octanesulfonylaminophenycarbamoyl, and di-n-octadecylcarbamoyl groups), a substituted or unsubstituted sulfamoyl group (e.g., sulfamoyl, methylsulfamoyl, dimethylsulfamoyl, diethylsulfamoyl, bis(2-methoxyethyl) sulfamoyl, di-n-butylsulfamoyl, methyl-n-octylsulfamoyl, n-hexadecylmethysulfamoyl, 3-ethoxypropylmethyl sulfamoyl, N-phenyl-N-methylsulfamoyl, 4-decyloxyphenylsulfamoyl, and methyloctadecylsulfamoyl group), and the like.

$R_1$ and $R_3$ each preferably represents a substituted or unsubstituted alkyl, alkenyl, alkynyl, aryl, heterocyclic, acyl or sulfonyl group, etc. $R_1$ and $R_3$ each preferably contains 1 to 40 carbon atoms.

$R_2$ preferably represents a substituted or unsubstituted acyl or sulfonyl group and preferably contains 1 to 40 carbon atoms.

X preferably represents an oxygen atom.

More preferred among the compounds represented by formula (II) are those represented by formula (III):

(III)

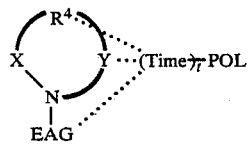

wherein Y represents a divalent linking group; and preferably

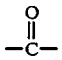

or —$SO_2$—; $R_4$ represents an atomic group necessary for forming a 5-membered to 8-membered monocyclic or condensed heterocyclic ring together with

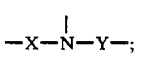

and N, X, EAG, Time, t, POL, and the dotted lines are each as defined in formula (II).
In formula (III),
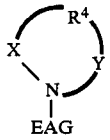
corresponds to PWR in formula (I), and (Time)—$_t$POL is bonded to at least one of $R_4$ and EAG.
Specific and preferred examples of the heterocyclic ring formed by X, Y, $R_4$, and N are shown below.
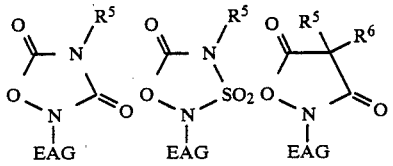
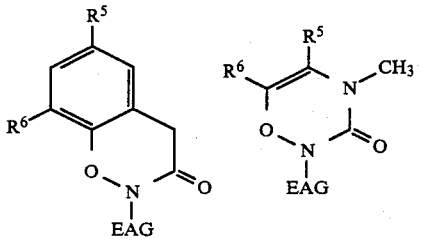
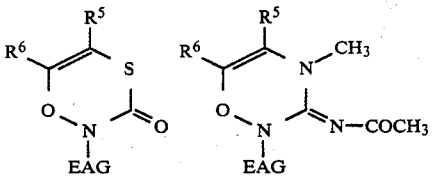
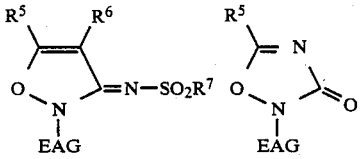
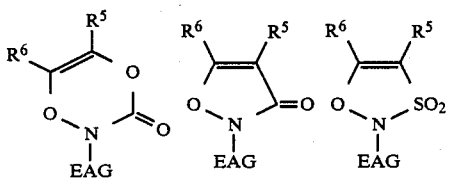
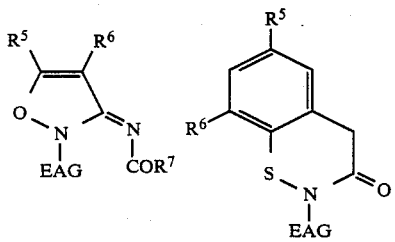
-continued
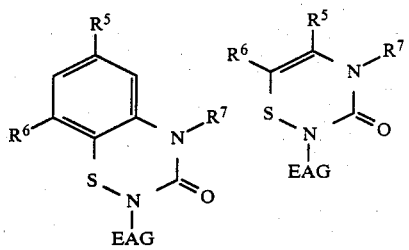
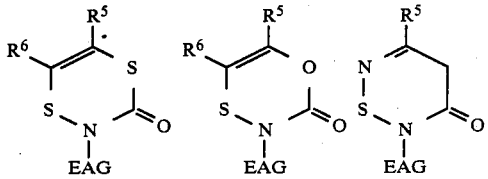
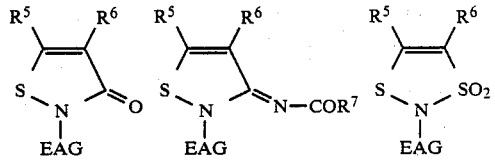
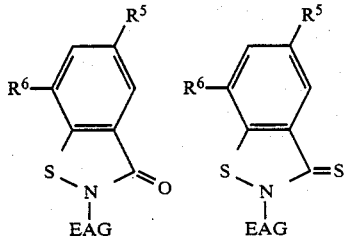
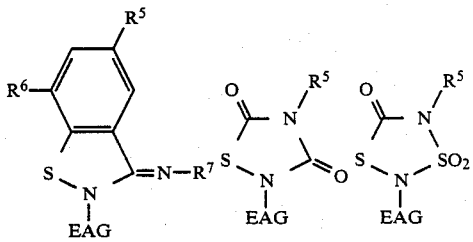
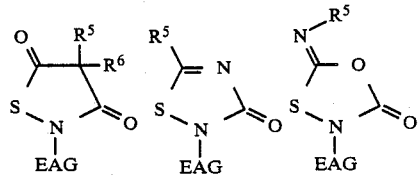
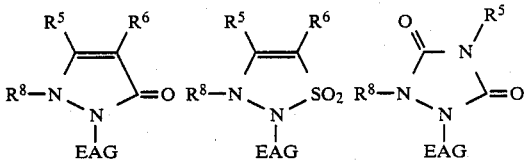

-continued

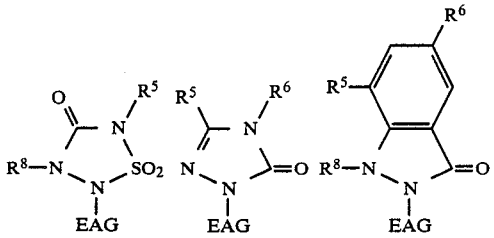

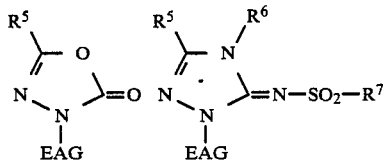

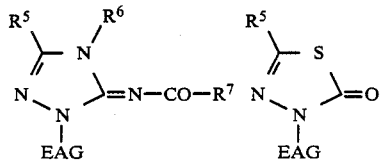

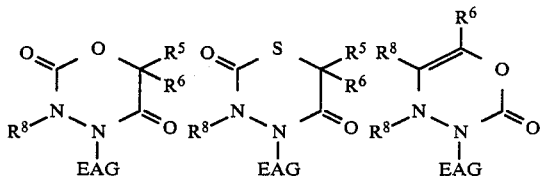

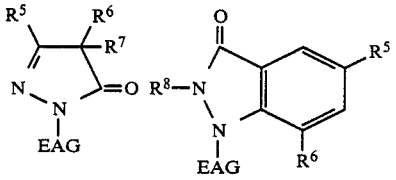

wherein $R^5$, $R^6$, and $R^7$ which may be the same or different, each represents a hydrogen atom, an alkyl group, an aryl group or a heterocyclic group; and $R^8$ represents an acyl group or a sulfonyl group.

Particularly preferred examples of these heterocyclic rings are shown below, in which the bonding position of $-(\text{Time})_t\text{POL}$ is also shown

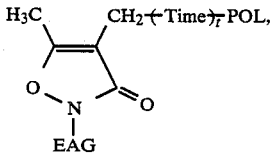

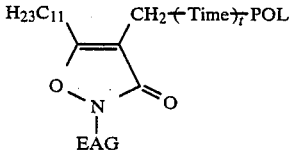

-continued

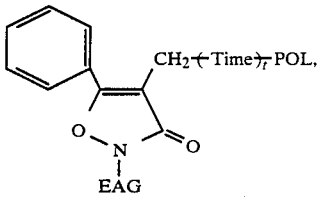

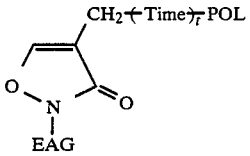

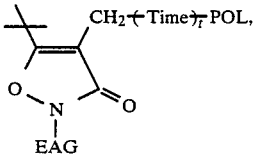

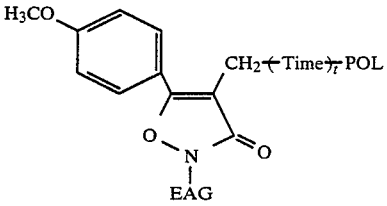

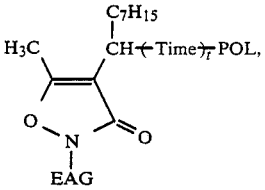

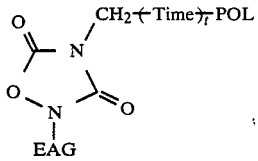

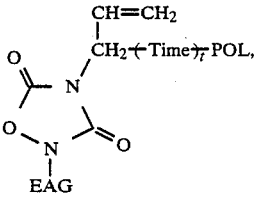

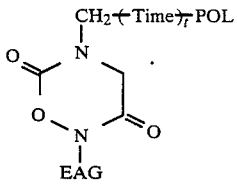

-continued
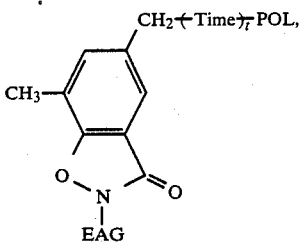
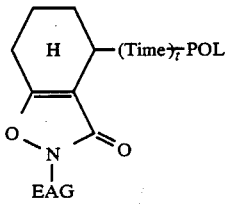
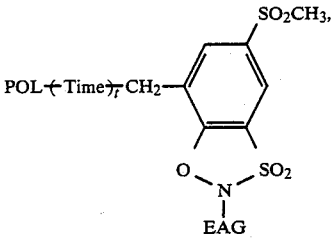
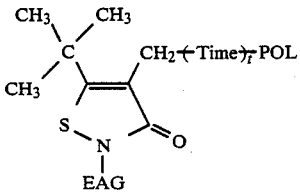
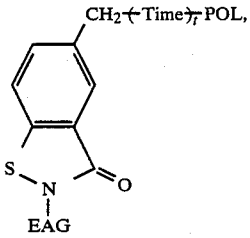
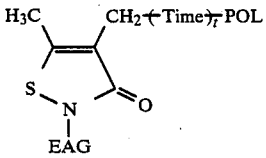
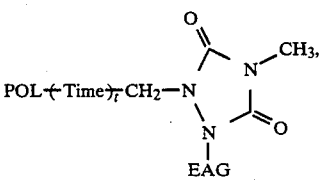
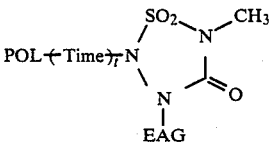
-continued
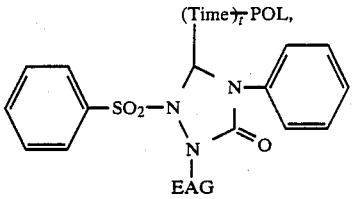
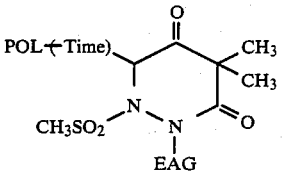
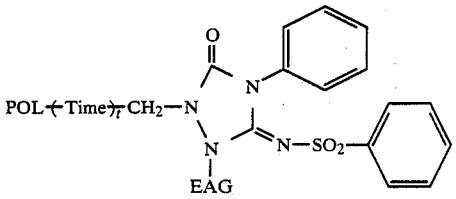
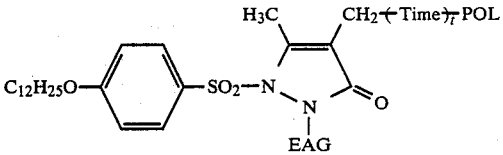
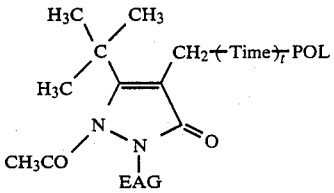
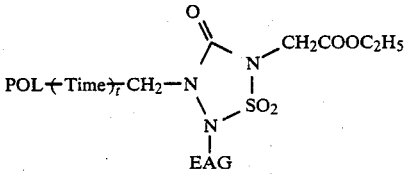
Throughout the specification, the symbols
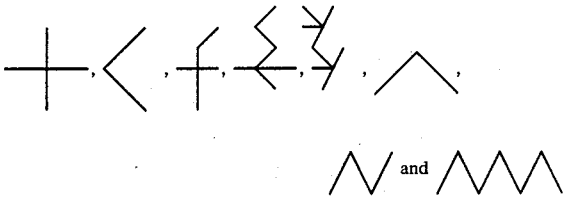
in the formulae represent
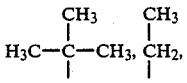

-continued

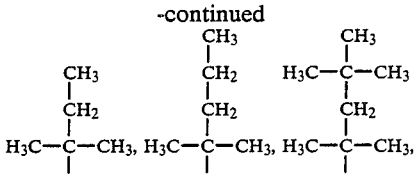

$-CH_2-$, $-CH_2-CH_2-$ and $-CH_2-CH_2-CH_2-CH_2-CH_2-$, respectively.

In formula (II), EAG represents an aromatic group which accepts an electron from a reducing substance and is bonded to the nitrogen atom. EAG preferably includes a group represented by formula (A):

(A)

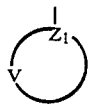

wherein $Z_1$ represents

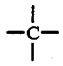

Sub or a nitrogen atom; and V represents an atomic group necessary for forming a 3-member to 8-membered aromatic ring containing memberes selected from

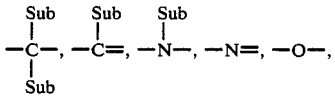

$-S-$ and $-So_2-$, wherein plural Sub groups may be the same or different, each Sub group represents a hydrogen atom or a substituent hereinafter described, and at least two Sub groups may be linked to form a 3-membered to 8-membered saturated or unsaturated carbon ring or heterocyclic ring; provided that the sum of the Hammett's sigma constants and Hammett's para constants of the Sub groups is at least +0.50, preferably at least +0.70, and more preferably at least +0.85.

EAG preferably represents an aryl or heterocyclic group substituted with at least one electron attractive group. The substituent on the aryl or heterocyclic group can be used for controlling physical properties of the compound as a whole, such as ease of electron acceptance, water solubility, oil solubility, diffusibility, sublimating properties, melting point, dispersibility in a binder (e.g., gelatin), reactivity to a nucleophilic group, reactivity to an electrophilic group, and the like.

Specific examples of the aryl group substituted with at least one electron attractive group are 4-nitrophenyl, 2-nitrophenyl, 2-nitro-4-N-methyl-N-n-butyl-sulfamoylphenyl, 2-nitro-4-N-methyl-N-n-dodecylsulfamolyphenyl, 2-nitro-4-N-methyl-N-n-hexadecylsulfamoylphenyl, 2-nitro-4-N-methyl-N-n-octadecylsulfamoylphenyl, 2-nitro-4-N-methyl-N-(3-carboxypropyl) sulfamoylphenyl, 2-nitro-4-N-ethyl-N-(2-sulfoethyl) sulfamoylphenyl, 2-nitro-4-N-n-hexadecyl-N-(3-sulfopropyl) sulfamoylphenyl, 2-nitro-4-N-(2-cyanoethyl)-N-[(2-hydroxyethoxy) ethyl]sulfamoylphenyl, 2-nitro-4-diethylsulfamoylphenyl, 2-nitro-4-di-n-butylsulfamoylphenyl, 2-nitro-4-di-n-octylsulfamoylphenyl, 2-nitro-4-di-n-octadecylsulfamoylphenyl, 2-nitro-4-methylsulfamoylphenyhl, 2-nitro-4-n-nhexadecylsulfamoylphenyl, 2-nitro-4-N-methyl-N-(4-dodecylsulfonylphenyl) sulfamoylphenyl, 2-nitro-4-(3-methylsulfamoylphenyl) sulfamoylphenyl, 4-nitro-2-N-methyl-N-n-butylsulfamoylphenyl, 4-nitro-2-N-methyl-N-n-octylsulfamoylphenyl, 4-nitro-2-N-methyl-N-n-dodecylsulfamoylphenyl, 4-nitro-2-N-methyl-N-n-hexadecylsulfamoylphenyl, 4-nitro-2-N-methyl-N-n-octadecylsulfamoylphenyl, 4-nitro-2-N-methyl-N-(3-carboxypropyl)sulfamoylphenyl, 4-nitro-2-N-ethyl-N-(2-sulfoethyl)sulfamoylphenly, 4-nitro-2-N-n-hexadecyl-N-(3-sulfopropyl)sulfamoylphenyl, 4-nitro-2-N-(2-cyanoethyl)-N-[(2-hydroxyethoxy)ethyl]sulfamoylphenyl, 4-nitro-2-diethylsulfamoylphenyl, 4-nitro-2-di-n-butylsulfamoylphenyl, 4-nitro-2-di-n-octylsulfamoylphenyl, 4-nitro-2-di-n-octadecylsulfamoylphenyl, 4-nitro-2-methylsulfamoylpehnyl, 4-nitro-2-n-hexadexylsulfamoylphenyl, 4-nitro-2-N-methyl-N-(4-dodecylsulfonylphenyl)sulfamoylphenyl, 4-nitro-2-(3-methylsulfamoylphenyl)sulfamoylphenyl, 4-nitro-2-chlorophenyl, 2-nitro-4-chlorophenyl, 2-nitro-4-N-methyl-N-n-butylcarbamoylphenyl, 2-nitro-4-N-methyl-N-n-octylcarbamoylphenyl, 2-nitro-4-N-methyl-N-n-dodecylcarbamoylphenyl, 2-nitro-4-N-methyl-N-n-hexadecylcarbamoylphenyl, 2-nitro-4-N-n-octadecylcarbamoylphenyl, 2-nitro-4-N-methyl-N-(3-carboxypropyl)carbamoylphenyl, 2-nitro-4-N-ethyl-N-(2-sulfoethyl)carbamoylphenyl, 2-nitro-4-N-n-hexadecyl-N-(3-sulfopropyl)carbamoylphenyl, 2-nitro-4-N-(2-cyanoethyl)-N-[(2-hydroxyethoxy)ethyl]carbamoylphenyl, 2-nitro-4-diethylcarbamoylphenyl, 2-nitro-4-di-n-butylcarbamoylphenyl, 2-nitro-4-di-n-octylcarbamoylphenyl, 2-nitro-4-di-n-octadecylcarbamoylphenyl, 2-nitro-4-methylcarbamoylphenyl, 2-nitro-4-n-hexadecylcarbamoylphenyl, 2-nitro-4-N-methyl-N-(4-dodecylsulfonyulphenyl)carbamoylphenyl, 2-nitro-4-(3-methylsulfamoylphenyl)cargbamoylphenyl, 4-nitro-2-N-methyl-N-n-butylcarbamoylphenyl, 4-nitro-2-N-methyl-N-n-octylcarbamoylphenyl, 4-nitro-2-N-methyl-N-n-dodecylcarbamoylphenyl, 4-nitro-2-N-methyl-N-n-hexadecylcarbamoylphenyl, 4-nitro-2-N-methyl-N-n-octadecylcarbamoylphenyl, 4-nitro-2-N-methyl-N-n-(3-carboxypropyl)carbamoylphenyl, 4-nitro-2-N-ethyl-N-(2-sulfoethyl)carbamoylphenyl, 4-nitro-2-N-n-hexadecyl-N-(3sulfopropyl)carbamoylphenyl, 4-nitro-2-N-(2-cyanoethyl)-N-[(2-hydroxyethoxy)ethyl]carbamoylphenyl, 4-nitro-2-diethylcarbamoylphenyl, 4-nitro-2-di-n-butylcarbamoylphenyl, 4-nitro-2-di-n-octylcarbamoylphenyl, 4-nitro-2-di-n-octadecylcarbamoylphenyl, 4-nitro-2-methylcarbamoylphenyl, 4-nitro-2-n-hexadecylcarbamoylphenyl, 4-nitro-2-N-methyl-N-(4-dodecylsulfonlyphenyl)carbamoylphenyl, 4-nitro-2-(3-methylsulfamoylphenyl)-carbamoylphenyl, 2,4-dimethanesulfonylphenyl, 2-methanesulfonyl-4-benzenesulfonylphenyl, 2-n-octanesulfonyl-4-methanesulfonylphenyl, 2-n-tetradecanesulfonyl-4-methanesulfonylphenyl, 2-n-hexadecanesulfonyl-4-methanesulfonylphenyl, 2,4-di-n-dodecanesulfonylphenyl, 2,4-diodecanesulfonyl-5-trifluoromethylphenyl, 2-n-decanesulfonyl-4-cyano-5-trifluoromethylphenyl, 2-cyano-4-methanesulfonylphenyl, 2,4,6-tricyanophenyl, 2,4-dicyanophenyl, 2-nitro-4-methanesulfonylphenyl, 2-nitro-4-n-dodecanesulfonylphenyl, 2-nitro-4-(2-sulfoethylsulfonyl)phenyl, 2-nitro-4-carboxymethylsulfonylphenyl, 2-nitro-4-carboxyphenyl, 2-nitro-4-ethoxycarbonyl-5-n-butoxyphenyl, 2-nitro-4-ethoxycarbonyl-5-n-hexadecyloxyphenyl, 2-nitro-4-diethylcarbamoyl-5-n-hexadecyloxyphenyl, 2-nitro-4-cyano-5-n-dodecylphenyl, 2,4-dinitrophenyl, 2-nitro-4-n-decylthiophenyl, 3,5-dinitrophenyl, 2-nitro-3,5-dimethyl-4-n-hexadecanesulfonylphenyl, 4-methanesulfonyl-2-benzene-sulfonylphenyl, 4-n-octanesulfonyl-2-methanesulfonylphenyl, 4-n-tetradecanesulfonyl-2-methanesulfonylphenyl, 4-n-hexadecanesulfonyl-2-methanesulfonylphenyl, 2,5-didodecanesulfonyl-4-trifluoromethylphenyl, 4-n-decanesulfonyl-2-cyano-5-trifluoromethylphenyl, 4-cyano-2-methanesulonylphenyl, 4-nitro-2-methanesulfonylophenyl, 4-nitro-2-n-dodecanesulfonylphenyl, 4-nitro-2-(2-sulfoethylsulfonyl)phenyl, 4-nitro-2-carboxymethylsulfonylphenyl, 4-nitro-2-carboxyphenyl, 4-nitro-2-ethoxycarbonyl-5-n-butoxyphenyl, 4-nitro-2-ethoxycarbonyl-5-n-hexadecyloxyphenyl, 4-nitro-2-diethylcarbamoyl-5-n-hexadecyloxyphenyl, 4-nitro-2-cyano-5-n-dodecylphenyl, 4-nitro-2-n-decylthiophenyl, 4-nitro-3,5-dimethyl-2-n-hexadecanesulfonylphenyl, 4-nitronaphtyl, 2,4-dinitronaphthyl, 4-nitro-2-n-octadecylcarbamoylnaphthyl, 4-nitro-2-dioctylcarbamoyl-5-(3-sufobenzenesulfonylmanio)naphthyl, 2,3,4,5,6-pentafluorophenyl, 2-nitro-4-benzoylphenyl, 2,4-diacetylphenyl, 2-nitro-4-trifluoromethylphenyl, 4-nitro-2-trifluoromethylphenyl, 4-nitro-3-trifluoromethylphenyl, 2,4,5-tricycanophenyl, 3,4-dicyanophenyl, 2-chloro-4,5-dicyanophenyl, 2-bromo-4,5-dicyanophenyl, 4-methanesulfonylphenyl, 4-n-hexadecanesulfonylphenyl, 2-decanesulfonyl--5-trifluoromethylphenyl, 2-nitro-5-methylphenyl,2-nitro-5-n-octadecyloxyphenyl, 2-nitro-4-N-(vinysulfonylethyl)-N-methylsulfamoylphenyl, and 2-methyl-6-nitrobenzoxazol-5-yl groups.

Specific examples of the heterocyclic group are 2-pryridyl, 3-pyridyl, 4-pyridyl, 5-nitro-2-pyridyl, 5-nitro-N-hexadecylcarbamoyl-2-pyridyl, 3,5-dicyano-2-pyridyl, 5-dodecanesulfonyl-2-pyridyl, 5-cyano-2-pyrazyl, 4-nitrothiophen-2-yl, 5-nitro-1,2-dimethylimidazol-4-yl, 3,5-diacetyl-2-pyridyl, 2-dodecyl-5-carbamoylpyridinium-2-yl, 5-nitro-2-furyl, and 5-nitrobenzothiazol-2-y groups.

Time represents a group capable of releasing POL upon cleavage of a nitrogen-oxygen bond, a nitrogen-nitrogen bond or a nitrogen-sulfur bond as a trigger, through a subsequent reaction.

Various known groups, e.g., those described in Japanese patent application (OPI) Nos. 147244/86 (pp. 5–6) and 2364549/86 (pp. 8–14), and European Pat. No. 220,746 A2 (pp. 11–22), can be used as Time.

Preferred examples of the group represented by Time are set forth below, where (*) denotes the position at which the group is connected to PWR in formula (I) or the position at which the group is bonded as indicated by the dotted line in formula (II) or (III), and (*) (*) denotes the position at which the group is connected to POL.

(1)

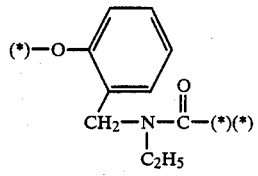

(2)

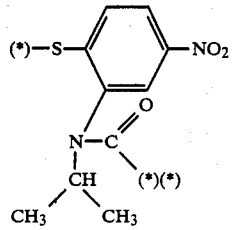

(3)

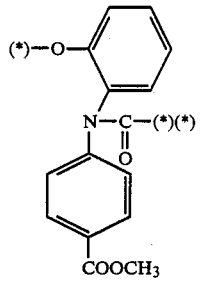

(4)

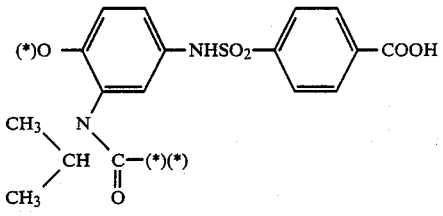

(5)

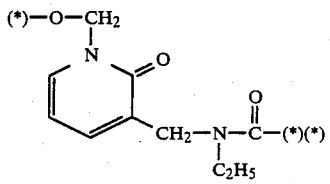

(6)

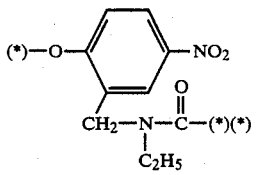

(7)

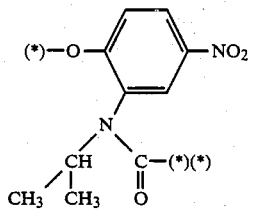

-continued
(8)
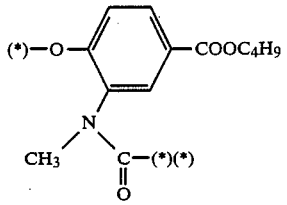
(9)
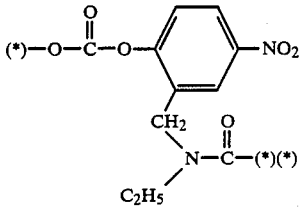
(10)
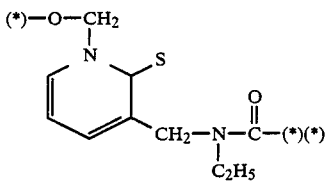
(11)
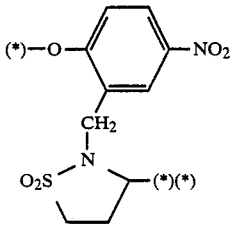
(12)
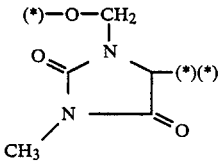
(13)
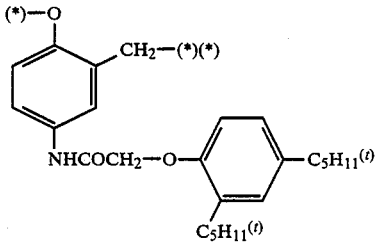
(14)
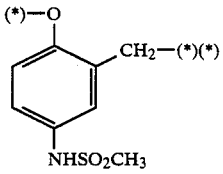
-continued
(15)
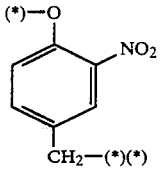
(16)
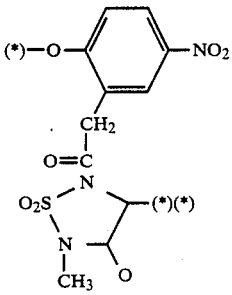
(17)
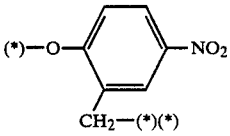
(18)
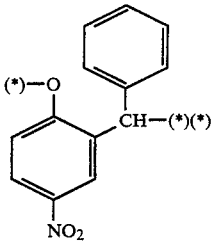
(19)
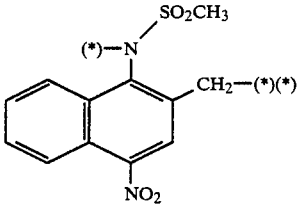
(20)
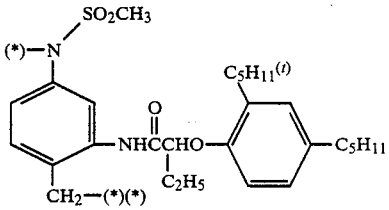

-continued
(21)
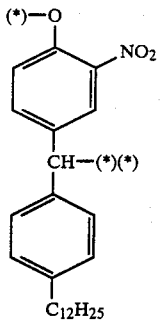
(22)
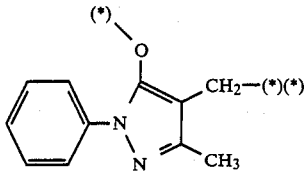
(23)
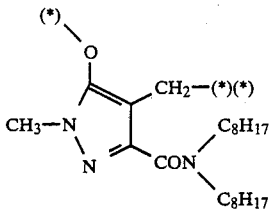
(24)
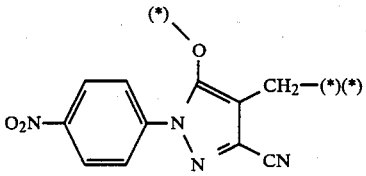
(25)
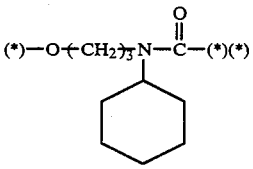
(26)
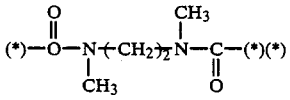
(27)
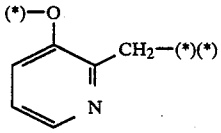
(28)
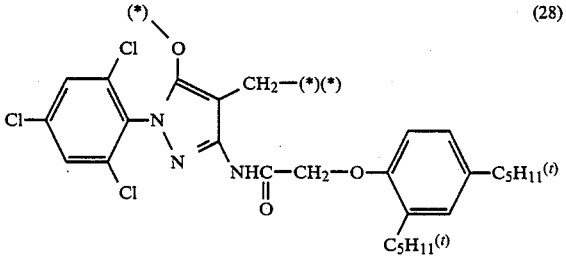
-continued
(29)
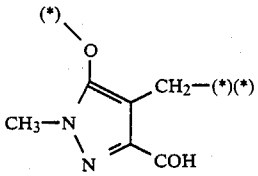
(30)
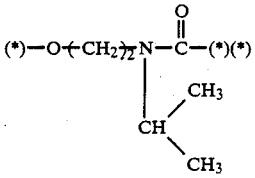
(31)
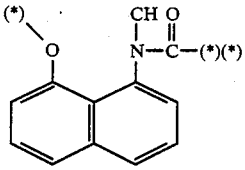
(32)
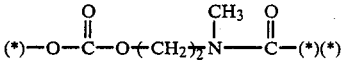
(33)
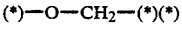
(34)
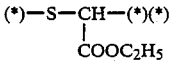
(35)
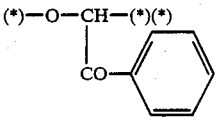
(36)
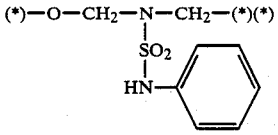
(37)
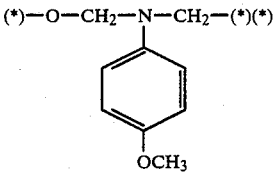
(38)
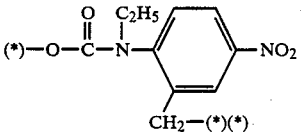
(39)
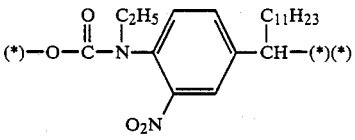

-continued (40)

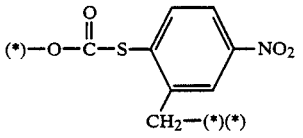

(41)

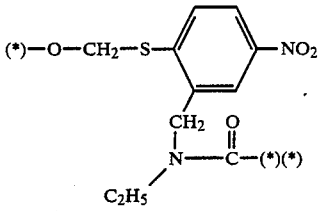

(42)

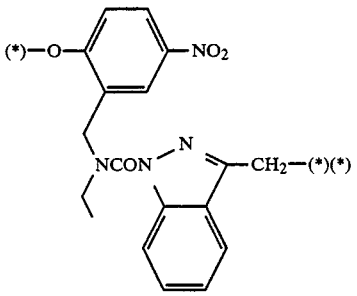

In the compound represented by formula (I), POL represents a polymer group. The polymer group has preferably an average molecular weight of not less than about 1,500. POL is a polymer group which reveals a photographically useful function, or loses a photographically useful function possessed by the compound represented by formula (I) according to the present invention, upon being released from the compound represented by formula (I) at the time of development processing. The photographically useful functions used include, for example, development inhibition, development acceleration, nucleation, color image formation upon a coupling reaction or by diffusible or non-diffusible dyes, desilvering acceleration, desilvering inhibition, silver halide solution, control of redox reaction, development, fixing acceleration, fixing inhibition, silver image stabilization, improvement in tone, improvement in processing dependency, improvement of dot, color image stabilization, light filtering, irradiation control, antihalation, improvement in coating properties, hardening, desensitization, contrast intensification, chelation of dyes, etc., mordanting, antistain, brightening, ultraviolet ray absorption, nucleating acceleration, etc.

Particularly useful groups represented by POL include those which posses the above-described function under the state of connecting with PWR, and lose this function when cleaved from PWR at development processing (for example, quaternary ammonium salt polymer mordants, etc.), those which do not have the above described function under the state of connecting with PWR, but exhibit the function when cleaved from PWR at development processing (for example, desilvering accelerator precursor polymers, fixing accelerator precursor polymers, sulfinic acid precursor polymers, reducing agent precursor polymers, mordant precursor polymers, etc.), and those which become water-soluble when cleaved from PWR and are dissolved in a processing solution (for example, carboxylic acid ester polymers, etc.), etc.

Of the polymer groups represented by POL, vinyl polymer groups having a repeating unit represented by formula (X) are particularly preferred.

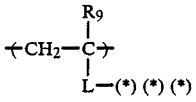

(X)

wherein (*) (*) (*) denotes the position at which the group is connected to —Time—$_t$PWR; $R_g$ represents a hydrogen atom or a lower alkyl group (for example, a methyl group, an ethyl group, etc.); and L represents a chemical bond or a divalent linking group.

The divalent linking groups represented by L preferably include those represented by formula (L-1or (L-2):

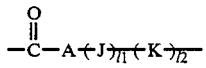

(L-1)

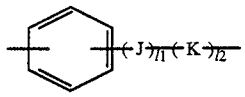

(L-2)

wherein A represents —O— or

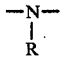

(wherein R represents a hydrogen atom or a lower alkyl group, preferably having up to 6 carbon atoms); J represents an alkylene group (preferably having up to 10 carbon atoms, which may contain an amido bond, an ester bond or an ether bond therein, and specifically including, for example, a methylene group, an ethylene group, a trimethylene group, a 2-hydroxytrimethylene group, —$CH_2OCH_2$—, —$CH_2CONHCH_2$—, etc.) or an arylene group (preferably having from 6 to 12 carbon atoms, and specifically including, for example, a p-phenylene group, etc.); K represents —COO—, —OCO—, —CONH—, —NHCO—, —$SO_2NH$—, or —$NHSO_2$—; and $l_1$ and $l_2$ each is 0 to 1.

Preferred specific examples of the divalent linking group represented by L are set forth below, but the present invention is not to be construed as being limited thereto.

—CONH— L-1

—$COOCH_2CH_2OCO$— L-2

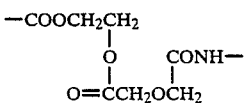

L-3

—COO— L-4

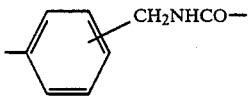

L-5

-continued $-CONHCH_2CH_2CONH-$ L-6

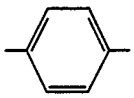

L-7

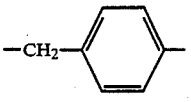

and

L-8

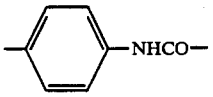

L-9

Other specific examples of L include:

$-CONHCH_2-$, $-CONH(CH_2)_2-$, $-CONHCH_2OCOCH_2-$, $-CONH(CH_2)_3OCOCH_2-$, $-COOCH_2-$, $-CONHCH_2CONH-$, $-CONHC(CH_3)_2CONH-$, $-CONH(CH_2)_3CONH-$, $-CONH(CH_2)_5CONH-$, $-COO(CH_2)_2-$, $-COO(CH_2)_2OCOCH_2-$, $-COO(CH_2)_3OCOCH_2-$ and

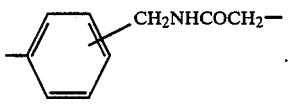

Another preferred example of POL is a copolymer groups obtained by copolymerization of vinyl monomers having the repeating unit described above and other copolymerizable vinyl monomers.

The compounds represented by formula (I) according to the present invention have various applications in silver halide photographic materials, including for example, the following:

(1) The compound according to the present invention wherein POL is a quaternary ammonium salt polymer can mordant a specific layer with anionic dyes, and demordant these dyes upon disappearance of the positive charges in development processing. Using the compound, modification of spectral sensitivity distribution, processing of photographic light-sensitive material in a light place, improvement in image sharpness, and improvement in tone of silver image, etc. are performed.

(2) The compound according to the present invention wherein POL is a polymer capable of being dissolved into a processing solution during the processing is employed for obtaining increase in covering power of silver image, and development acceleration, etc.

(3) The compound according to the present invention wherein POL is a polymer capable of trapping iodine ions, etc. is effective for obtaining development acceleration, and fixing acceleration, etc.

(4) The compound according to the present invention where POL is an ultraviolet ray absorbing agent precursor polymer (a polymer with increased ultraviolet ray absorbing function at processing) can provide ultraviolet ray absorbing function to a specific layer without decrease in sensitivity, whereby fastness of a color image can be achieved.

(5) The compound according to the present invention wherein POL is a brightening agent precursor polymer (a polymer with increased brightening function at processing) can provide brightening function to a specific layer without any advese influence on spectra sensitivity distribution, and thus, increase in whiteness in a white background is attained and light fading of color image can be restrained by the brightening agent.

(6) The compound according to the present invention wherein POL is a reducing agent precursor polymer can provide development acceleration, stain inhibition in white background, improved fastness of a color image, etc.

(7) The compound according to the present invention wherein POL is a silver halide solvent precursor polymer has a large solvent effect than a low molecular silver halide solvent, and consequently development acceleration and fixing acceleration can be effectively achieved.

(8) The compound according to the present invention wherein POL is a polymer capable of trapping substances which hinder desilvering and bleaching can provide desilvering acceleration and bleaching acceleration.

(9) The compound according to the present invention wherein POL is a polymeric base can effect development acceleration, and it is possible to selectively dye a layer after processing using the polymeric base as a mordant.

The above described applications utilize over-all release of POL at development processing to provide or remove a function.

On the other hand, it is possible to distribute reducing agents reversely corresponding to the development of silver halide, by using the reducing agents previously incorporated, and to generate POL reversely corresponding to the development of silver halide using the distribution of reducing agents. Some examples of such applications are specifically illustrated below.

The compound wherein POL is a quaternary ammonium salt polymer and loses its positive charge at processing is applicable to positive-positive color image forming system. The compound wherein POL is a polymer capable of being dissolved into a processing solution at processing can be applied to formation of a polymer relief image. Further, the compound wherein POL is a brightening agent precursor polymer or a sulfinic acid precursor polymer can be utilized for increasing whiteness in a white background and preventing formation of stain.

The compounds according to the present invention can be utilized for other purposes by changing the kind of POL and method of use, in addition to the above described examples of application.

Specific examples of compounds according to the present invention are set forth below, but the present invention is not to be construed as being limited thereto.

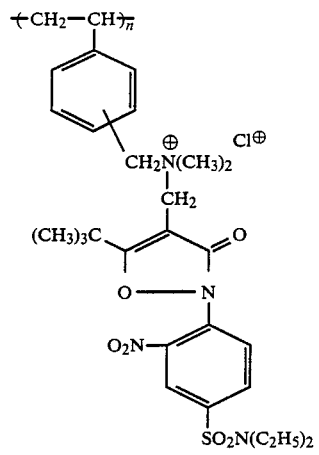
(1)
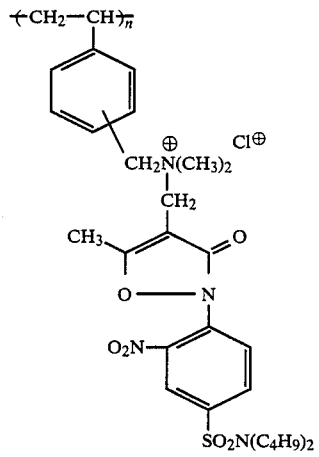
(2)
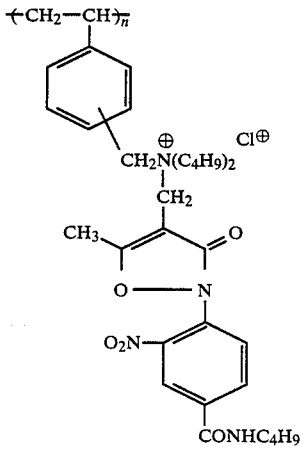
(3)

-continued
(4)
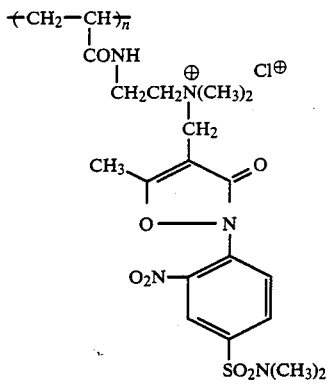
(5)
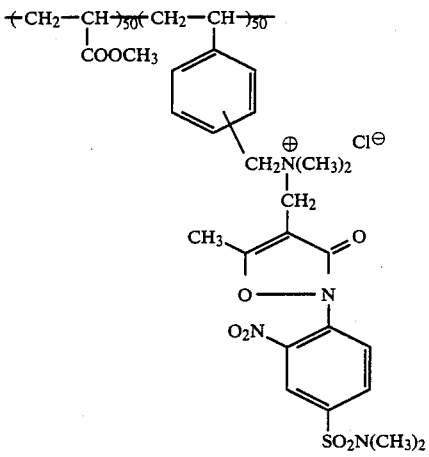
(6)
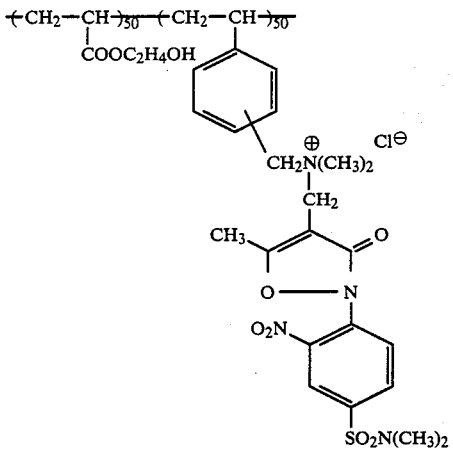
(7)
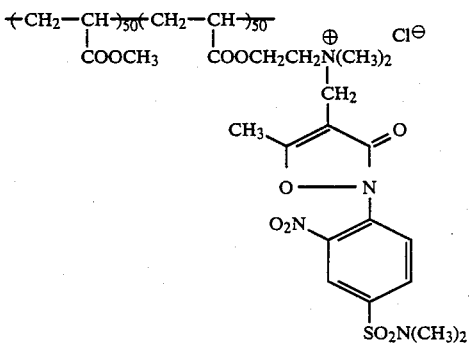

-continued
(8)
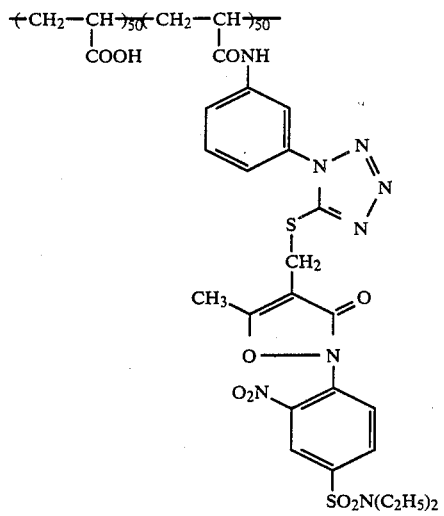
(9)
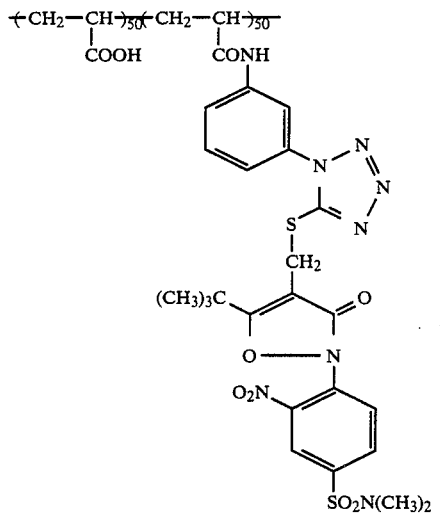
(10)
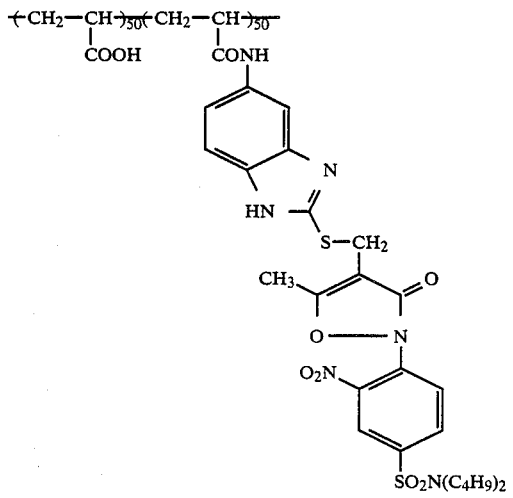

-continued
(11)
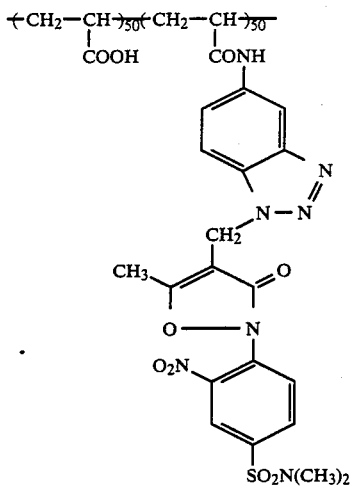
(12)
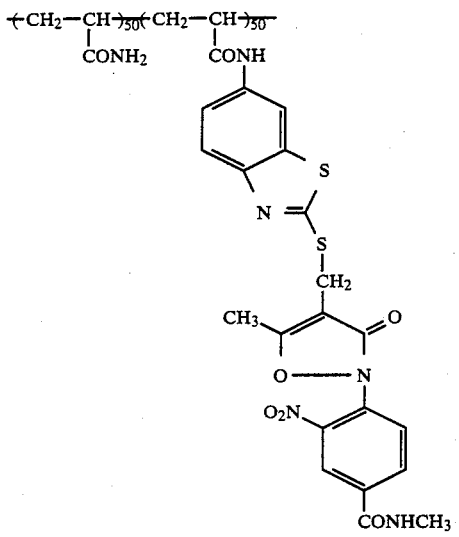
(13)
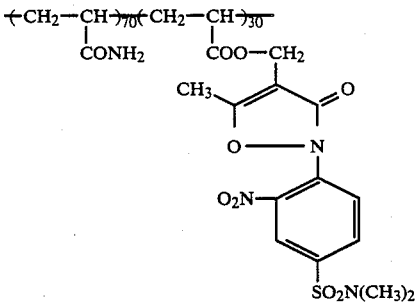
(14)
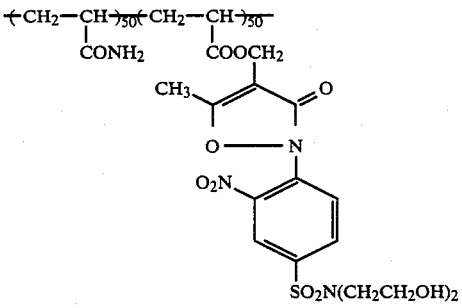

-continued
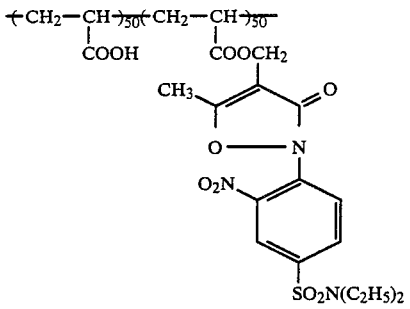
(15)
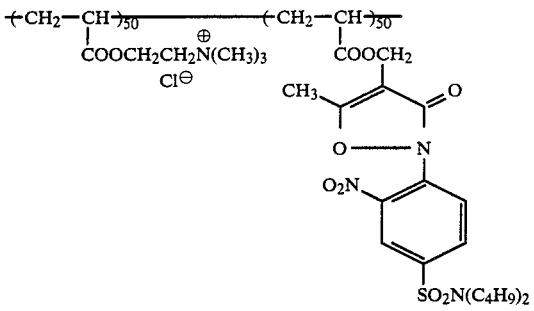
(16)
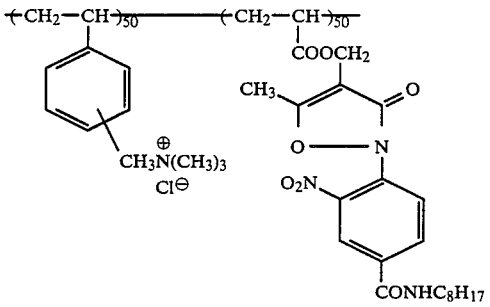
(17)
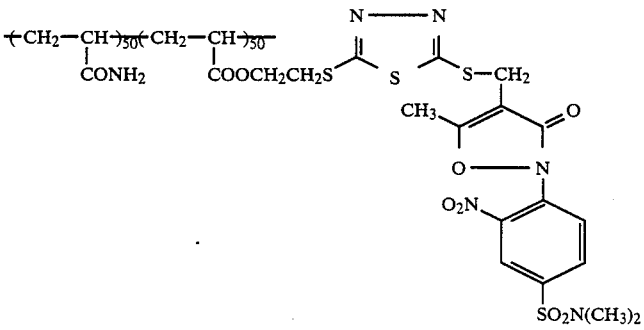
(18)

-continued
(19)
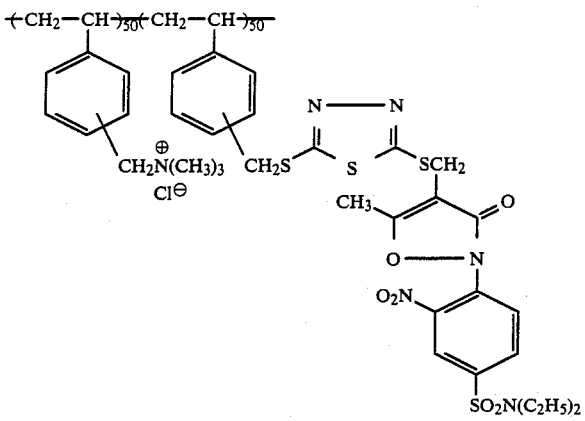
(20)
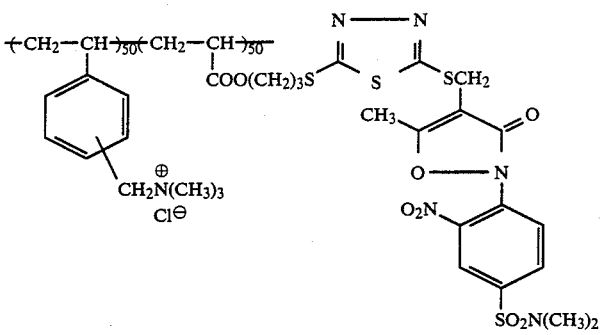
(21)
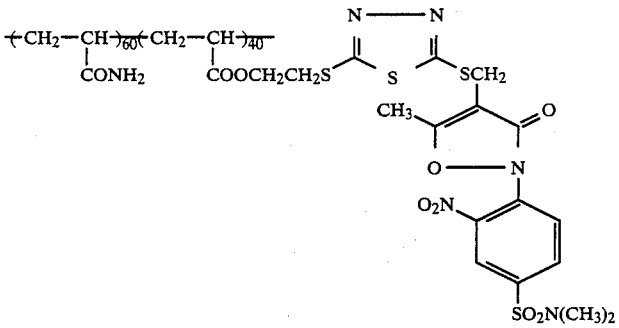
(22)
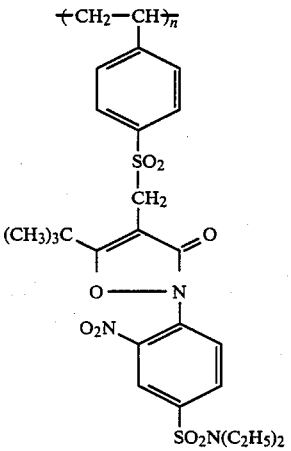

-continued
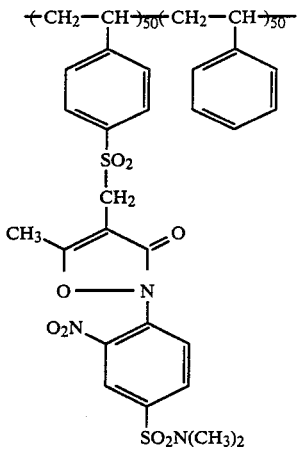
(23)
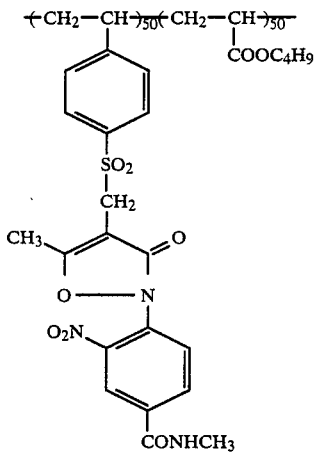
(24)
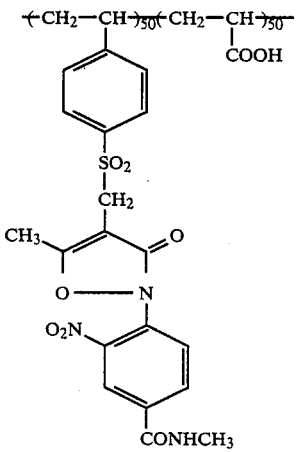
(25)

-continued
(26)
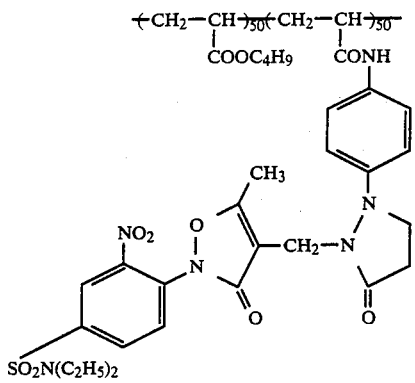
(27)
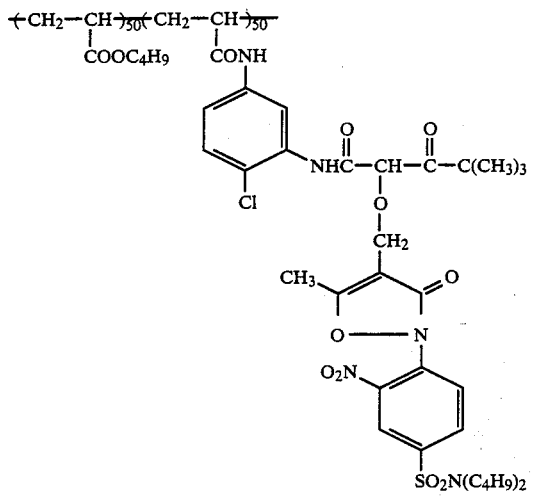
(28)
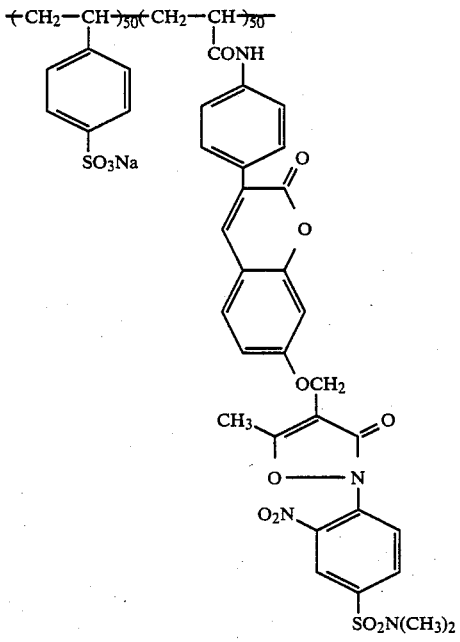

-continued
(29)
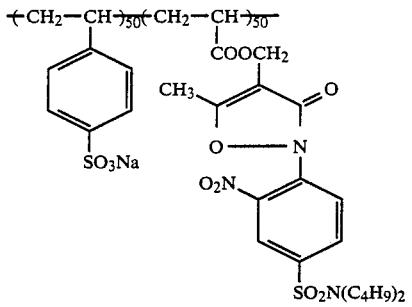
(30)
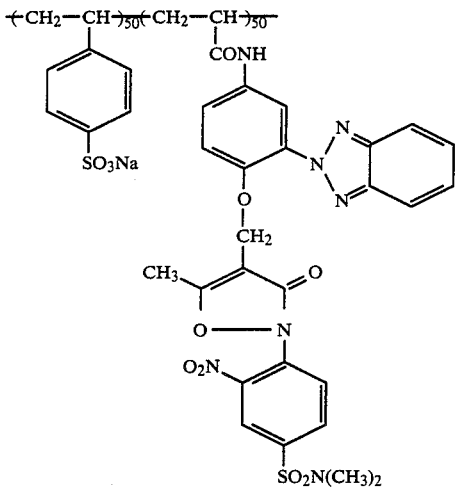
(31)
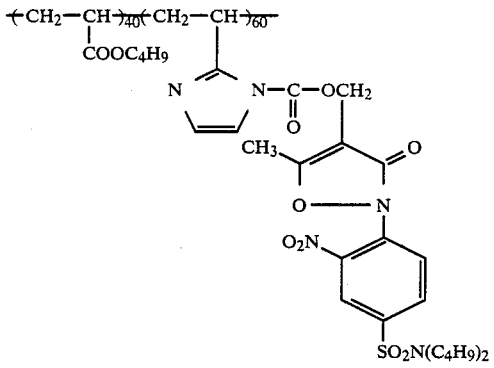
(32)
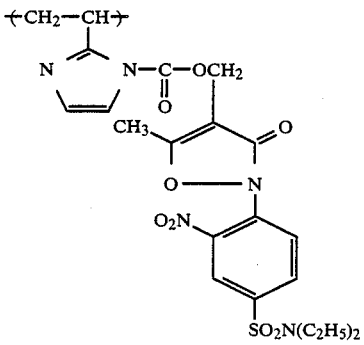
Now, methods for synthesis of the compound represented by formula (I) according to the present invention are described below.
The compounds according to the present invention can be mainly synthesized according to either of two schemes A and B as shown below.
SCHEME A:

-continued

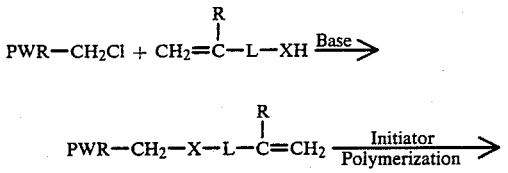

Compound of Present Invention

SCHEME B:

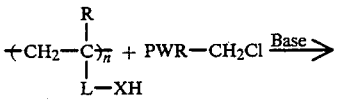

Compound of Present Invention

Adoption of the method for synthesis can be appropriately performed depending on kinds of L, X and PWR. If the group represented by PWR causes severe hindrance to polymerization due to the kind of PWR used, the method of Scheme B is selected.

A synthesis example of the compound according to the present invention is specifically described below.

SYNTHESIS EXAMPLE

Synthesis of Compound (2)

Compound (2) was synthesized according to the route schematically shown below.

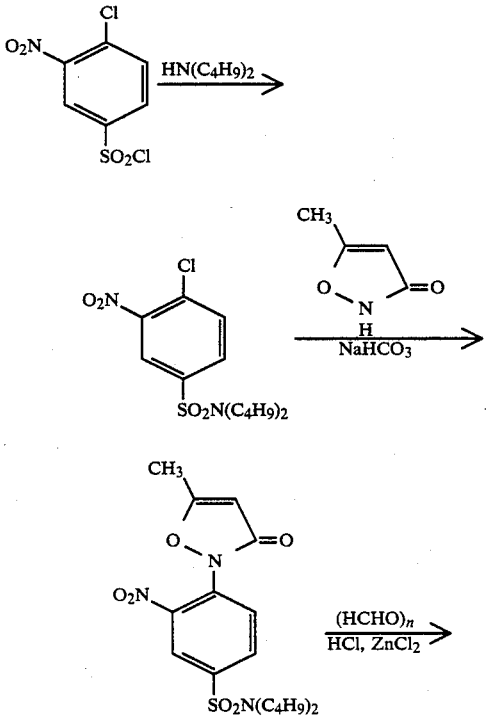

-continued

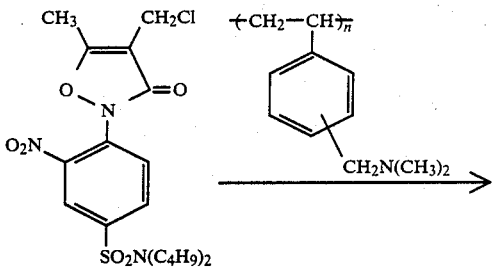

Compound (2)

Synthesis of 5-methyl-3-hydroxyisoxazole:

The compound can be easily synthesized with reference to methods described in the following publications and patents:

*Sankyo Kenkyu-Sho Nenppo,* Vol. 22, page 215 (1970), Japanese Patent Publication No. 9675/77, *Bulletin de la societe chimique de France,* page 1978, Japanese patent application (OPI) Nos. 206668/82 and 206667/82, *Tetrahedron,* Vol. 20, page 2835 (1964), Japanese patent application (OPI) Nos. 194867/83 and 70878/82, Japanese Patent Publication No. 48953/74, Japanese patent application (OPI) No. 190977/84, *Journal of Organic Chemistry,* Vol. 48, page 4307 (1983), *Chemical and Pharmacentical Bulletin,* Vol. 14, page 277, *Heterocycles,* Vol. 12, No. 10, page 1297, *Canadian Journal of Chemistry,* Vol. 62, page 1940, Japanese patent application (OPI) No. 501907/84.

The compound was synthesized by the method described in Japanese patent application (OPI) No. 501907/84. Melting point 85° or 86° C.

Synthesis of N,N-dibutyl-4-chloro-3-nitrobenzenesulfonamide

To 565 g of dibutylamine were added 2.5 liters of water and 230 g of sodium hydroxide and the mixture was cooled to 0° C. To the mixture was added dropwise 1400 ml of an acetonitrile solution containing 1120 g of 3-nitro-4-chlorobenzenesulfonyl chloride while maintaining at 10° C. or lower. After the completion of the reaction, 100 ml of concentrated hydrochloric acid was added thereto. The crystals thus deposited were collected by filtration, washed with water and dried. Yield: 1208 g (79.2%). Melting point: 67° to 68° C.

Synthesis of 5-methyl-2-(4-dibutylsulfamoyl-2-nitrophenyl)-4-isoxazolin-3-one A mixture of 600 g of N,N-dibutyl-4-chloro-3-nitrobenzenesulfonamide, 220 g of 5-methyl-3-hydroxyisoxazole, 300 g of sodium hydrogen carbonate and 1.5 liter of dimethylsulfoxide was reacted at 80° C. for 6 hours. The reaction mixture was cooled to 40° C., 1.2 liter of methanol was added thereto, and then 400 ml of concentrated hydrochloric acid was added thereto at 25° C. After stirring for 30 minutes, 800 ml of water was added thereto. The crystals thus deposited were collected by filtration, washed with water, recrystallized from methanol and dried. Yield: 613 g (86.6%). Melting point: 84° to 86° C.

Synthesis of
5-methyl-4-chloromethyl-2-(4-dibutylsulfamoyl-2-nitrophenol)-4-isoxazolin-3-one A mixture of 65 g of 5-methyl-2-(4-dibutylsulfamoyl-2-nitrophenyl)-4-isoxazolin-3-one, 28 g of zinc chloride, 39 g of paraformaldehyde, 150 ml of acetic acid and 2 ml of concentrated sulfinic acid was stirred at 80° C. for 2 hours while bubbling through 20 l/hr of hydrogen chloride gas. After cooling, the reaction solution was poured into a mixture solution of 540 ml of methanol and 27 ml of water and stirred. The crystals thus deposited were collected by filtration and recrystallized from methanol. Yield: 54.6 g (75.1%). Melting point: 57° to 58° C.

Synthesis of Compound (2)

A mixture of 32.2 g of poly(dimethylaminomethylstyrene), 92 g of 5-methyl-4-chloromethyl-2-(4-dibutylsulfamoyl-2-nitrophenyl)-4-isoxazolin-3-one and 300 ml of benzyl alcohol was heated at 90° C. for 16 hours with stirring. After cooling, the reaction solution was poured into 1 liter of diethyl ether. The solid thus precipitated was collected by filtration and dissolved in methanol. To the methanol solution was added diethyl ether to precipitate again. The solid was collected and dried in vacuum to obtain 58 g of Compound (2) according to the present invention.

The compound according to the present invention can be employed either in a light-sensitive layer or in other constituting layers (for example, a propective layer, an intermediate layer, a filter layer, an antihalation layer, an image receiving layer, etc.).

The compound according to the present invention can be added to a coating solution of a hydrophilic colloid as an aqueous solution or a water-miscible organic solvent solution of the compound when the compound is water-soluble. The compound dispersed in the form of a latex can be added as it is to a coating solution of a hydrophilic colloid. Further, when the compound is an oil-soluble polymer, it can be disposed in a coating solution of a hydrophilic colloid using a dispersion method conventionally employed for dispersing a coupler (for example, an oil dispersing method, a Fischer dispersing method, etc.). Moreover, the compound may be dispersed by a solid dispersing method without using any solvent.

The amount of the polymer used according to the present invention can be varied appropriately over a broad range. The preferred amount used varies depending on the function which POL performs, but it is used generally in a range from about 10 mg to 10 g, preferably in a range from about 50 mg to 5 g, per $m^2$ of the support.

Because the compound of formula (I) releases a photographically useful group or its precursor on receipt of an electron from a reducing substance, the reducing substance is, in turn, oxidized. If the oxidation-reduction reaction takes place imagewise, the reducing substance which is not oxidized remains in a reverse image.

The reducing substance which can be used in the present invention may be either organic or inorganic and preferably has an oxidation potential lower than the standard redox potential of a silver ion/silver system, e.g., 0.80 V.

The inorganic reducing substances include metals having an oxidation potential of 0.8 V or less (e.g., Mn, Ti, Si, Zn, Cr, Fe, Co, Mo, Sn, Pb, W, Sb, Cu, and Hg) $H_2$, ions having an oxidation potential of 0.8 V or less or complex compounds thereof (e.g., $Cr^{2+}$, $V^{2+}$, $Cu^{+}$, $Fe^{2+}$, $MnO_4^{2-}$, $I^-$, $Co(CN)_6^{4-}$, $(Fe\text{-}EDTA)^{2-}$, etc.), metal hydrides having an oxidation potential of 0.8 V or less (e.g., NaH, LiH, KH, $NaBH_4$, $LiBH_4$, $LiAl(O—C_4H_9—t)_3H$, $LiAl(OCH_3)_3H$, etc.), and sulfur or phosphorous compounds having an oxidation potential of 0.8 V or less (e.g., $Na_2SO_3$, NaHS, $NaHSO_3$, $H_3P$, $H_2S$, $Na_2S$, $Na_2S_2$, etc.).

The organic reducing substances include organic nitrogen compounds, such as alkylamines or arylamines; organic sulfur compounds such as alkylmercaptans or arylmercaptans; organic phosphorous compounds, such as alkylphosphines or arylphosphines, and preferably compounds following Kendal-Pelz formula, described in T. H. James, *The Theory of the Photographic Process*, page 299 (4th ed., 1977).

Examples of the compounds usable as reducing substance in the present invention include inorganic reducing agents, such as sodium sulfite, sodium hydrogensulfite, etc., benzenesulfinic acids, hydroxylamines, hydrazines, hydrazides, borane-amine complexes, hydroquinones, aminophenols, catechols, p-phenylenediamines, 3-pyrazolidiones, hydroxytetronic acid, ascorbic acid, 4-amino-5-pyrazolones, and the like. In addition, the reducing agents described in pages 291 to 334 of the above described book by T. H. James as well as the reducing agent precursors described in Japanese patent application (OPI) Nos. 138736/81 and 40245/82 and U.S. Pat. No. 4,330,617 can be employed.

Specific examples of preferred reducing agents which can be used include 3-pyrazolidones and precursors thereof, e.g., 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, 1,5-diphenyl-3-pyrazolidone, 1-phenyl-4-methyl-4-stearoyloxymethyl-3-pyrazolidone, 1-phenyl-4-methyl-4-lauroyloxymethyl-3-pyrazolidone, 1-phenyl-4,4-bis(lauroyloxymethyl)-3-pyrazolidone, 1-phenyl-2-acetyl-3-pyrazolidone, 1-phenyl-3-acetoxy-pyrazolidone, etc.; hydroquinones and precursors thereof, e.g., hydroquinone, toluhydroquinone, 2,6-dimethylhydroquinone, t-butylhydroquinone, 2,5-di-t-butylhydroquinone, t-octylhydroquinone, 2,5-di-t-octylhydroquinone, pentadecylhydroquinone, sodium 5-pentadecylhydroquinone-2-sulfonate, p-benzolyloxyphenol, 2-methyl-4-benzoyloxyphenol, 2-t-butyl-4-(4-chlorobenzoyloxy)phenol, sodium hydroquinone-2-sulfonate, 2-[3,5-bis(2-hexyldecanamido)benzamido]hydroquinone, 2-(3-hexadecanamido)benzamidohydroquinone, 2-(2-hexyldecanamido)hydroquinone, etc.; p-phenylenediamine color developing agents, e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-butoxyethylaniline, 3-methyl-4-amino-N-ethyl-N-β-methanesulfonamidoethylaniline, 4-amino-3-methyl-N-ethyl-N-β-methoxyethylaniline, etc.; and aminophenol reducing agents, e.g., 4-amino-2,6-dichlorophenol, 4-amino-2,6-dibromophenol, 4-amino-2-methylphenol sulfate, 4-amino-3-methylphenol sulfate, 4-amino-2,6-dichlorophenol hydrochloride, etc. 2,6-Dichloro-4-substituted sulfonamidophenols and 2,6-dibromo-4-substituted sulfonamidophenols described in *Research Disclosure,* Vol. 151, No. 15108 (Nov., 1976) and U.S. Pat. No. 4,021,240, and p-(N,N-dialkylaminophenyl)sulfamines described in Japanese patent application (OPI) No. 116740/84 are also useful. In addition to the above phenolic reducing agents, naphthol reducing agents, such as 4-aminonaphthol derivatives described in Japanese patent application (OPI) No. 259253/86 and 4-substituted sulfonamidonaphthol derivatives as described in *Research Disclosure,* Vol. 178, No. 17842 (Feb., 1979) and Japanese patent application (OPI) No. 88136/81 are also useful. General color developing agents applicable as reducing agent further include aminohydroxypyrazole derivatives described in U.S. Pat. No. 2,895,825, aminopyrazoline derivatives described in U.S. Pat. No. 2,892,714, and hydrazone derivatives described in *Research Disclosure,* Vol. 194, Nos. 19412, pp. 227–230 (June, 1980) and ibid., Vol. 194, No. 19415, pp. 236–240 (June, 1980). These color developing agents may be used either individually or in combinations of two or more thereof.

In the case of incorporating a diffusion-resistant reducing substance into the photographic light-sensitive material, it is preferred to use an electron transfer agent (ETA) together with the reducing substance, in order to promote electron transfer between the reducing substance and a developable silver halide emulsion.

The electron transfer agent used can be selected from the above described reducing substances. In order for the electron transfer agent (ETA) to act more preferably, it is desired that its mobility be greater than that of the immobile reducing substance. In such cases, the reducing substance which is used together with ETA may be any one of the above-described reducing substances which is substantially immobile in the layer of the photographic light-sensitive material. Particularly, hydroquinones, aminophenols, aminonaphthols, 3-pyrazolidinones, saccharin and precursors thereof, picoliniums, and electron donors as described in Japanese patent application (OPI) No. 11087/78, etc. are preferred.

Specific examples of preferred reducing agents are set forth below, but the present invention is not to be construed as being limited thereto.

S-1

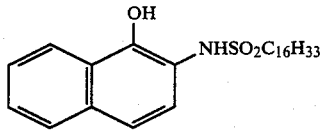

S-2

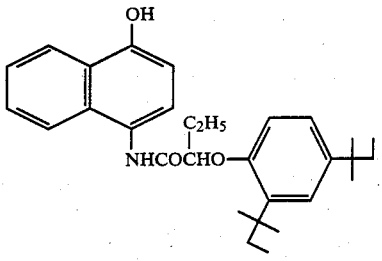

S-3

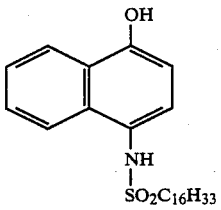

S-4

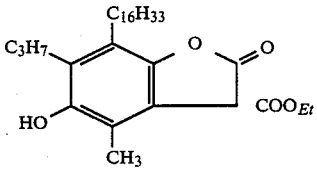

S-5

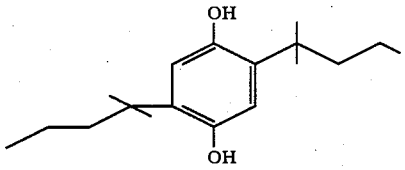

-continued
S-6
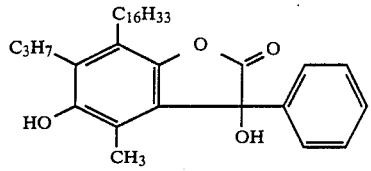
S-7
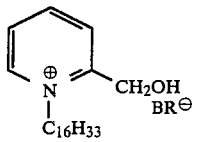
S-8
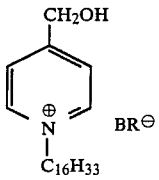
S-9
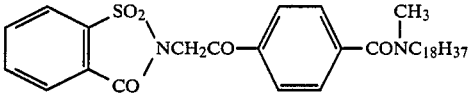
S-10
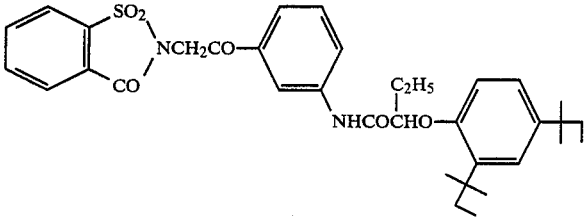
S-11
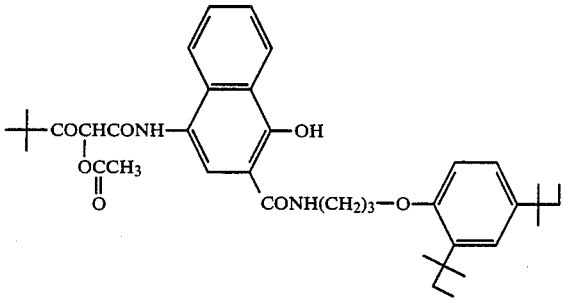
S-12
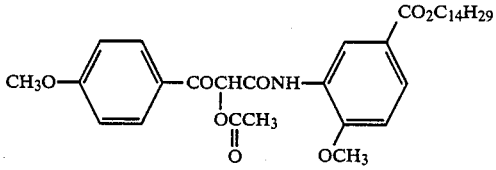
S-13
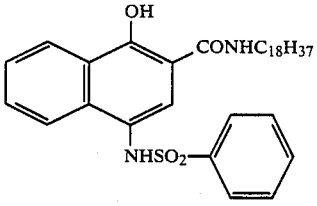

-continued
S-14
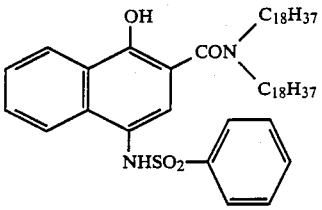
S-15
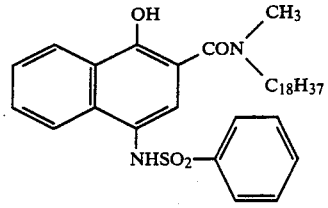
S-16
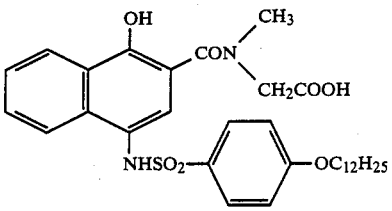
S-17
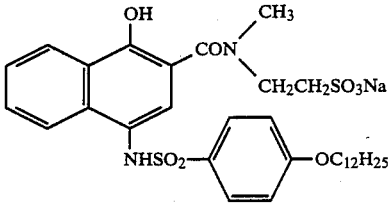
S-18
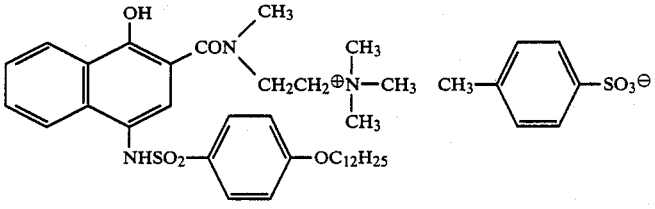
S-19
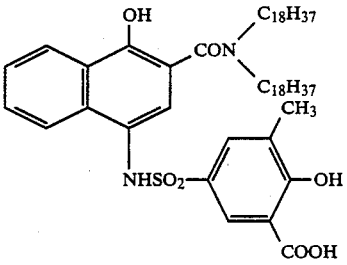
S-20
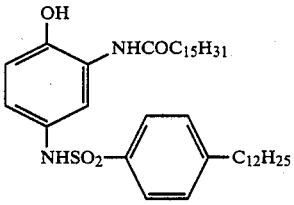

-continued
S-21
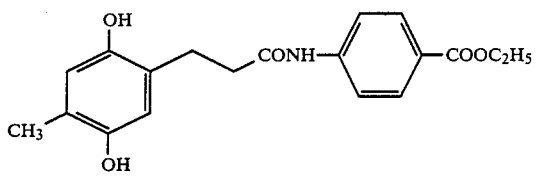
S-22
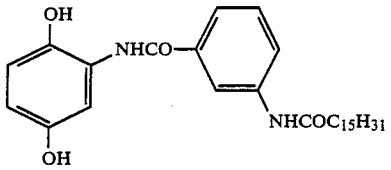
S-23
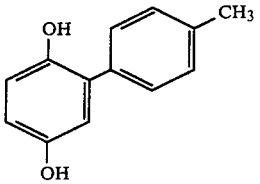
S-24
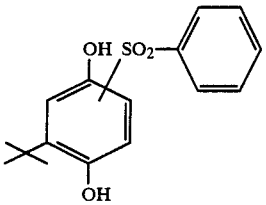
S-25
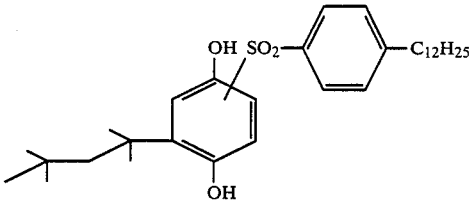
S-26
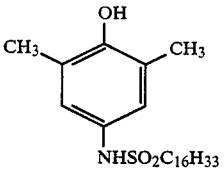
S-27
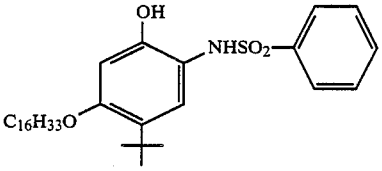
S-28
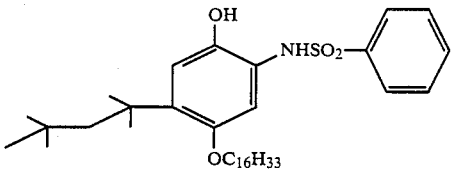

-continued
S-29
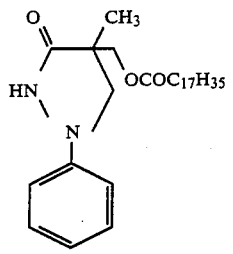
S-30
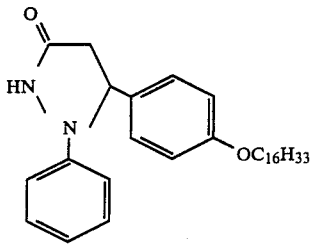
S-31
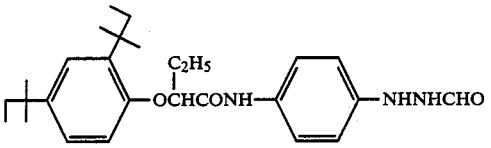
S-32
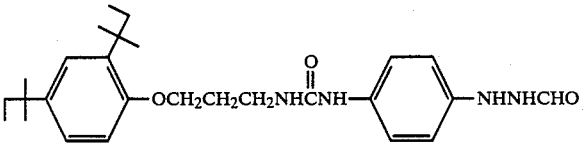
S-33
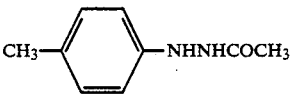
S-34
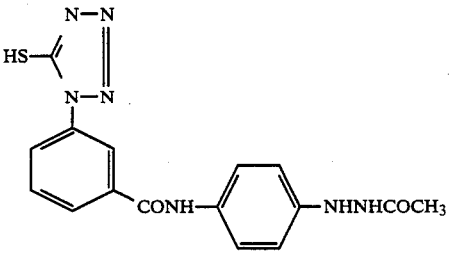
S-35
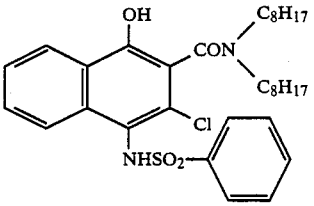

-continued
S-36
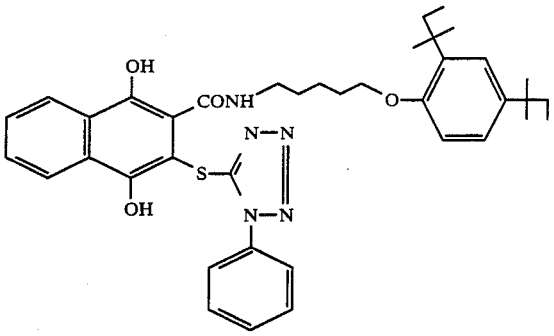
S-37
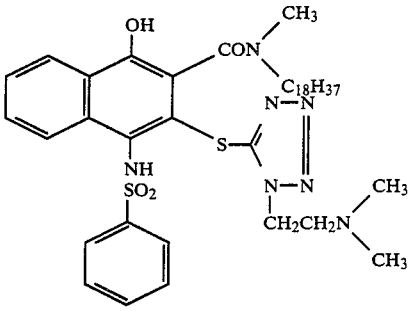
S-38
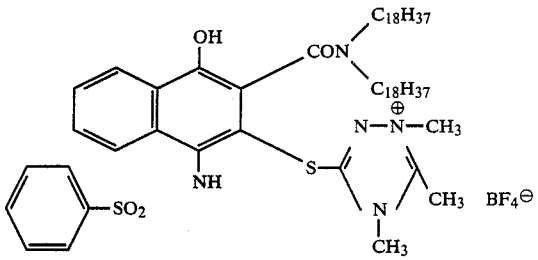
S-39
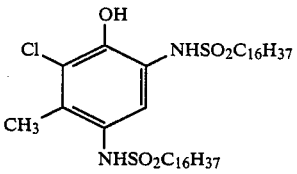
S-40
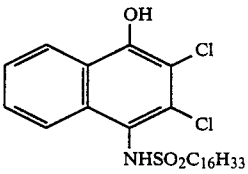
S-41
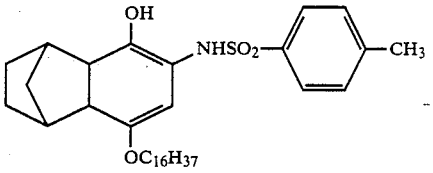

-continued
S-42
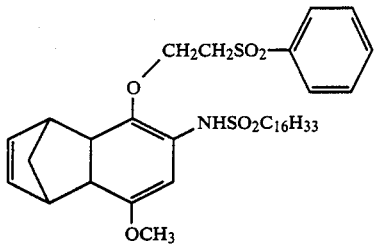
S-43
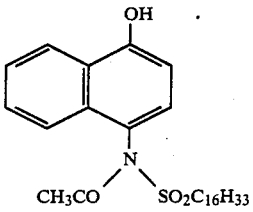
S-44
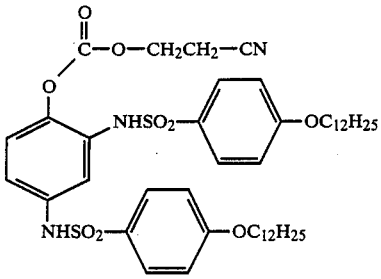
S-45
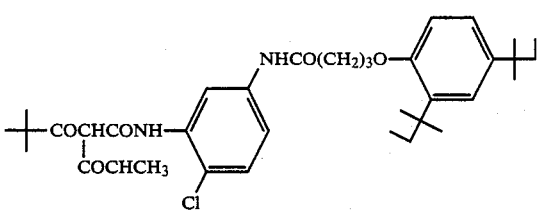
S-46
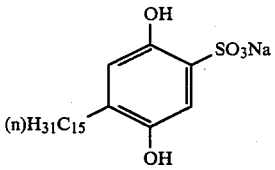
S-47
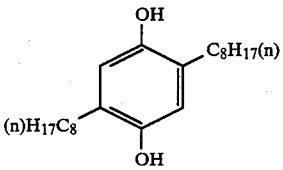
S-48
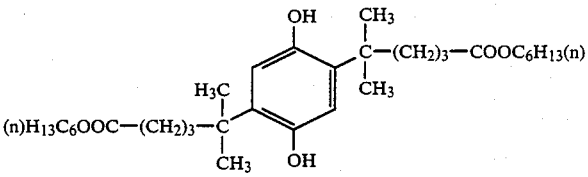

-continued

S-49

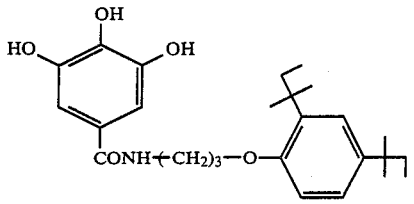

S-50

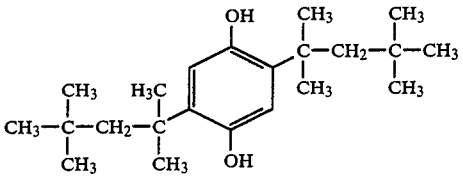

S-51

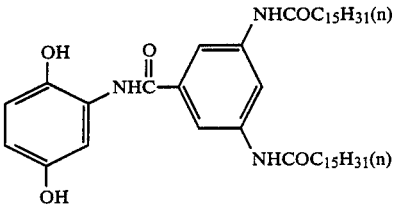

S-52

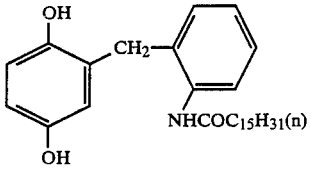

S-53

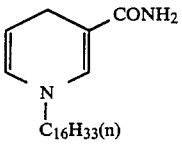

The ETA which is employed in combination with the reducing substance may be any ETA an oxidized product of which can be cross-oxidized with the reducing substance. Preferred examples thereof include diffusible 3-pyrazolidinones, aminophenols, phenylenediamines, and reductions.

The photographic light-sensitive material of the present invention can be applied to conventional photographic light-sensitive materials which are developed using a developing solution near normal temperature or to heat-developable photographic light-sensitive materials.

In case the present invention is applied to conventional photographic light-sensitive materials, as a system for the reaction of the above-described reducing substance or the above-described combination of a reducing substance and ETA with the photographic light-sensitive material, a system wherein the reducing substance or the combination of the reducing substance and ETA is applied to the photographic light-sensitive material in the form of a developing solution at development and a system wherein the reducing substance is previously incorporated into the photographic light-sensitive material and the ETA is applied to the photographic material in the form of a developing solution are preferred. In the former system, the preferred amount used is from about 0.001 mol/l to 1 mol/l, which is the concentration of both substance(s) in the total developing solution. In the latter system of previous incorporation, about 0.01 to 50 mol of the reducing substance is preferably incorporated into the photographic material per mol of the compound according to the present invention, and the concentration of ETA in the solution is preferably from about 0.001 mol/l to 1 mol/l.

On the other hand, when the present invention is applied to a heat developable photographic light-sensitive material, it is preferred that the reducing substance or the combination of the reducing substance and ETA be incorporated into the heat developable photographic light-sensitive material. In this case, the total amount of the reducing substance is from about 0.01 to 50 mol, preferably from about 0.1 to 5 mol, per mol of the compound according to the present invention, and is from about 0.001 to 5 mol, preferably from about 0.01 to 1.5 mol per mol of silver halide.

The silver halide which can be used in the present invention may include any of silver chloride, silver bromide, silver iodide, silver chlorobromide, silver chloroiodide, silver iodobromide, and silver chloroiodobromide.

The halogen composition in the silver halide grains may be uniform, or the silver halide grains may have a multiple structure in which the composition differs between a surface portion and an inner portion (see Japanese patent application (OPI) Nos. 154232/82, 108533/83, 48755/84 and 52237/84, U.S. Pat. No. 4,433,048 and European Pat. No. 100,984, etc.).

Also, a tabular grain silver halide emulsion containing grains having a thickness of about 0.5 μm or less, a diameter of at least about 0.6 μm and an average aspect ratio of about 5 or more (see U.S. Pat. Nos. 4,414,310 and 4,435499, and West German patent application (OLS) No. 3,241,646 A1, etc.), and a monodisperse emulsion having a nearly uniform distribution of grain size (see Japanese patent application (OPI) Nos. 178235/82, 100846/83 and 14829/83, PCT Application (OPI) No. 83/02338 A1, and European Pat. Nos. 64,412 A3 and 83,377 A1, etc.) may be used in the present invention.

Two or more kinds of silver halides in which the crystal habit, halogen composition, grain size and/or distribution of grain size, etc. are different from each other may be used in mixture. Further, two or more kinds of monodisperse emulsions having different grain sizes from each other may be employed in mixture to control gradation.

The average grain size of the silver halide used in the present invention is preferably from about 0.001 μm to 10 μm, and more preferably from about 0.001 μm to 5 μm.

These silver halide emulsions can be prepared by any of an acid process, a neutral process, and an ammonia process. Further, a reaction system of soluble silver salts and soluble halogen salts may be any of a single jet process, a double jet process and a combination thereof. In addition, a reverse mixing process in which silver halide grains are formed in the presence of an excess of silver ions, or a controlled double jet process in which the pAg in the liquid phase is kept constant, can also be utilized.

Moreover, for the purpose of increasing growth of grains, the concentration of addition, the amount of addition and/or speed of addition of silver salts and halogen salts added may be raised (see Japanese patent application (OPI) Nos. 142329/80 and 158124/80, and U.S, Pat. No. 3,650,757, etc.).

Furthermore, silver halide grains of epitaxial junction type (see Japanese patent application (OPI) No. 16124/81, and U.S. Pat. No. 4,094,684, etc.) may be employed.

In the step for formation of silver halide grains used in the present invention, ammonia, an organic thioether derivative as described in Japanese Patent Publication No. 11386/72, or a compound containing sulfur as described in Japanese patent application (OPI) No. 144319/78, etc., can be used as a solvent for silver halide.

In a process of the formation of physical repening of silver halide grains, a cadmium salt, a zinc salt, a lead salt, or a thallium salt, etc., may be present. These salts are used for the purposes of improving photographic performance against pressure, etc. Further, for the purpose of eliminating high-intensity reciprocity failure or low-intensity reciprocity failure, a water-soluble iridium salt such as iridium (III or IV) chloride, ammonium hexachloroiridiate, etc. or a water-soluble rhodium salt such as rhodium chloride, etc., can be used.

Soluble salts may be removed from the silver halide emulsion after precipitate formation or physical ripening, and a noodle washing process or a flocculation process can be used for this purpose.

While the silver halide emulsion may be employed without being subjected to after-ripening, it is usually chemically sensitized. For the chemical sensitization, a sulfur sensitization method, a reduction sensitization method, and a noble metal sensitization method, etc., which are known in the field of emulsions for conventional photographic light-sensitive materials can be applied alone or in combination therewith. Such a chemical sensitization may be carried out in the presence of a nitrogen-containing heterocyclic compound (see Japanese patent application (OPI) Nos. 126526/83 and 215644/83, etc.).

The silver halide emulsion used in the present invention can be a surface latent image type in which a latent image is formed mainly on the surface of grains, or an internal latent image type in which a latent image is formed mainly in the interior of grains. Further, a direct reversal emulsion in which an internal latent image type emulsion and a nucleating agent are used in combination may be used. Examples of the internal latent image type emulsions suitable for this purpose are described in U.S. Pat. Nos. 2,592,250 and 3,761,276, Japanese Patent Publication No. 3534/83, and Japanese patent application (OPI) No. 136641/82, etc. Preferred examples of the nucleating agents suitably used in the present invention are described in U.S. Pat. Nos. 3,227,552, 4,245,037, 4,255,511, 4,266,031 and 4,276,364, and West German patent application (OLS) No. 2,635,316, etc.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes is applicable to these dyes as a basic heterocyclic nucleus. That is, a pyrroline nucleus, an oxazoline nucleus, a thiazole nucleus, a selenazole nucleus, an amidazole nucleus, a tetrazole nucleus, a pyridine nucleus, etc., and further, nuclei formed by condensing an alicyclic hydrocarbon ring with these nuclei and nuclei formed by condensing an aromatic hydrocarbon ring with these nuclei, that is, an indolenine nucleus, a benzindolenine nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, nuclei having a ketomethylene structure, 5- or 6-membered heterocyclic nuclei such as a pyrazolin-5-one nucleus, a thiohydantion nucleus, a 2-thiooxazolidin-2,4-dione nucleus, a thiazolidin-2,4-dione nucleus, a rhodanine nucleus, a thiobarbituric acid nucleus, etc., may also be used.

These sensitizing dyes can be employed individually, and can also be employed in combinations thereof. A combination of sensitizing dyes is often used, particularly for the purpose of supersensitization.

The sensitizing dyes may be present in the emulsion together with dyes which themselves do not give rise to spectrally sensitizing effects but which exhibit a supersensitizing effect, or materials which do not substantially absorb visible light but which exhibit a supersensitizing effect. For example, aminostilbene compounds substituted with a nitrogen-containing heterocyclic group (for example, those described in U.S. Pat. Nos. 2,993,390 and 3,635,721, etc.), aromatic organic acidformaldehyde condensates (for example, those described in U.S. Pat. No. 3,743,510, etc.), cadmium salts, azaindene compounds, etc., can be present. The combinations as described in U.S. Pat. 3,615,613, 3,615,641, 3,617,295 and 3,635,721 are particularly useful.

Gelatin is preferably used as the binder or protective colloid in the emulsion layers or intermediate layers of the present photographic materials, but other conventional hydrophilic colloids may be used alone or together with gelatin.

The gelatin may be either a lime processed gelatin or acid processed gelatin in the present invention. Details on the preparation of gelatins are given in Arther Vaise, *The Macromolecular Chemistry of Gelatin,* (Academic Press, 1964).

The photographic emulsions used in the present invention may contain surfactants singly or in the form of a mixture thereof.

These are essentially used as a coating auxiliary and sometimes for some other purposes such as emulsification and dispersion, improvement of photographic characteristics for sensitization, static charge prevention and blocking prevention. These surfactants are classified into natural surfactants such as saponin; nonionic surfactants such as alkyleneoxide type, glycerin type or glycidol type surfactants; cationic surfactants such as higher alkylamines, quaternary ammonium slats, pyridine and the like heterocyclic compounds or phosphonium or sulfonium salts; anionic surfactants containing an acidic group such as a carboxylic acid, sulfonic acid, phosphoric acid, sulfate or phosphate group; and ampholytic surfactants such as amino acids, aminosulfonic acids or aminoalcohol sulfates or phosphates.

The photographic emulsions used in the present invention may contain various compounds for the purpose of the prevention of fog in manufacture, storage or photographic processing of the photographic materials or for the purpose of stabilization of photographic characteristic of the materials. For these purposes, various compounds which are known as anti-fogging agents or stabilizers may be used, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole); mercaptopyrimidines; mercaptotriazines; thioketo compounds such as oxazolinthione; azaindenes such as triazaindenes, tetrazaindenes (especially 4-hydroxy-substituted (1,3,3a,7-tetrazaindene), pentazaindenes; as well as benzenethiosulfonic acid, benzenesulfinic acid and benzenesulfonic acid amide.

The photographic emulsion layers of the present photographic materials may contain, for the purpose of increasing sensitivity, intensification of contrast or acceleration of development, for example, thioether compounds, thiomorpholines, quaternary ammonium salt compounds, urethane derivatives, urea derivatives, imidazole derivatives or 3-pyrazolidones.

The present photographic materials may further contain, in the photographic emulsion layers or in any other hydrophilic colloid layers, a water insoluble or sparingly soluble synthetic polymer dispersion for the purpose of the improvement of the dimentional stability of the material. Polymers usable for this purpose are homopolymers or copolymers of alkyl (meth)acrylate, alkoxy alkyl (meth)acrylates, glycidyl (meth)acrylates, (meth)-acrylamides, vinyl esters (such as vinyl acetate), acrylonitriles, olefins and/or styrenes; as well as copolymers made of a combination of these monomers and other monomer components such as acrylic acid, methacrylic acid, $\alpha,\beta$-unsaturated dicarboxylic acids, hydroxyalkyl (meth)-acrylates, sulfoalkyl (meth)acrylates and styrenesulfonic acids.

The present photographic materials may contain in the photographic emulsion layers, or in any other hydrophilic colloid layers, an inorganic or organic hardener, for example, chromium salts (such as chromium alum, chromium acetate), aldehydes (such as formaldehyde, glyoxale, glutaraldehyde), N-methylol compounds (such as dimethylolurea, methyloldimethylhydantoin), dioxane derivatives (such as 2,3-dihydroxydioxane), active vinyl compounds (such as 1,3,5-triacryloyl-hexahydro-s-triazine, 1,3-vinylsulfonyl-2-propanol), active halogen-containing compounds (such as 2,4-dichloro-6-hydroxy-s-triazine), mucohalogenic acids (such as mucochloric acid, mucophenoxychloric acid) and like hardeners. They may be used singly or in the form of a combination thereof.

The silver halide photographic materials of the present invention may contain other various conventional additives well known in the art, for example, whitening agents, dyes, desensitizers, coating assistants, antistatic agents, plasticizers, sliding agents, matting agents, development accelerators, mordanting agents, ultraviolet light absorbents, discoloration inhibitors and color fog-preventing agents.

Examples of such additives which may be used in the present invention are disclosed, for example, in *Research Disclosure,* Vol. 176, RD. No. 17643 (Dec., 1978), pp. 22–31.

Various color couplers may be used in the present photographic materials. The term "color couplers" as used herein means compounds capable of forming dyes by a coupling reaction with an oxidized aromatic primary amine developing agent. Typical examples of usable color couplers are naphthol or phenol type compounds, pyrazolone or pyrazoloazole type compounds and open or heterocyclic ketomethylene compounds. Examples of cyan, magenta and yellow couplers which may be used in the present invention are described in the patents and publications referred to in *Research Disclosure,* Vol. 176, RD No. 17643 (Dec., 1978), Item VII-D and ibid., Vol. 187, RD No. 18717 (Nov., 1979).

The color couplers to be incorporated in the photographic materials of this invention are preferably non-diffusible and have a ballast group or are polymerized. Two-equivalent couplers, substituted with a coupling-off group, are preferred to four-equivalent couplers where the coupling active site has a hydrogen atom, because the amount of the silver coated is reduced. Further, couplers capable of forming a dye with a diffusibility, non-coloring coupler, a DIR coupler capable of releasing a development inhibitor on coupling, or a coupler capable of releasing a development accelerator on coupling may also be used.

Typical yellow couplers used in the present invention are oil protected acylacetamide couplers. Examples are described, e.g., in the U.S. Pat. Nos. 2,407,210, 2,875,057 and 3,265,506. Two-equivalent yellow couplers are preferably used in the present invention, and examples are oxygen atom-releasing type yellow couplers as described in U.S. Pat. Nos. 3,408,194, 3,447,928, 3,933,501, and 4,022,620; and nitrogen atom-releasing type yellow couplers as described in Japanese Patent Publication No. 10739/83, U.S. Pat. Nos. 4.401,752 and 4,326,024, *Research Disclosure,* Vol. 180, RD No. 18053 (Apr., 1979), British Pat. No. 1,425,020 and West German patent application (OLS) Nos. 2,219,917, 2,261,361, 2,329,587, and 2,433,812. The α-pivaloylacetanilide type couplers are excellent in the fastness of the colored dyes, in particular in the light fastness thereof, and the α-benzoylacetanilide type couplers generally form dyes of high color density.

The magenta couplers which may be used in the present invention are oil protected type indazolone or cyanoacetyl couplers especially, 5-pyrazolone or pyrazoloazole couplers, such as pyrazolotriazoles. Among the 5-pyrazolone couplers, those in which the 3-position is substituted by an arylamino group or an acylamino group are preferred in view of the hue or the color density of the colored dyes; typical examples thereof are described in U.S. Pat. Nos. 2,311,082, 2,343,703, 2,600,788, 2,908,573, 3,062,653, 3,152,896, and 3,936,015. As the releasable coupling-off group in the two-equivalent 5-pyrazolone type couplers, preferred are the nitrogen atomreleasing groups as described in U.S. Pat. No. 4,310,619 and the arylthio groups as described in U.S. Pat. No. 4,351,897. The 5-pyrazolone type couplers with a ballast group described in European Pat. No. 73,636 also can form dyes with a high color density and are useful herein.

Examples of pyrazoloazole type couplers useful herein are pyrazolobenzimidazoles as described in U.S. Pat. No. 3,061,432, preferably pyrazole(5,1-c)(1,2,4)triazoles as described in U.S. Pat. No. 3,725,067, pyrazolotetrazoles as described in *Research Disclosure,* Vol. 242, RD No. 24220 (June, 1984) and Japanese patent application (OPI) No. 33552/85 and pyrazolopyrazoles as described in *Research Disclosure,* Vol. 242, RD No. 24230 (June, 1984) and Japanese patent application (OPI) No. 43659/85. Imidazo(1,2-b) pyrazoles described in U.S. Pat. No. 4,500,630 are preferable because of the lower yellow side absorption of the colored dyes and the light fastness thereof, and in particular, pyrazolo(1,5-b)(1,2,4)triazoles as described in U.S. Pat. No. 4,540,654 are especially preferred.

Cyan couplers which may be used in the present invention are oil protected naphthol and phenol couplers; typical examples thereof are naphthol couplers as described in U.S. Pat. No. 2,474,293, especially oxygen atom-releasing two-equivalent naphthol couplers as described in U.S. Pat. Nos. 4,052,212, 4,146,396, 4,228,233 and 4,296,200. Examples of phenol couplers are given in, e.g., U.S. Pat. Nos. 4,369,929, 2,801,171, 2,772,162, and 2,895,826. Cyan couplers which are resistant to moisture and temperature are preferably used in the present invention, and typical examples thereof are phenol cyan couplers having an ethyl or higher alkyl group in the m-position of the phenol nucleus, as described in U.S. Pat. No. 3,772,002; 2,5-diacylamino substituted phenol couplers, as described in U.S. Pat. Nos. 2,772,162, 3,758,308, 4,126,396, 4,334,011, and 4,327,173, West German patent application (OLS) No. 3,329,729 and European Pat. No. 121,365; and phenol couplers having a 2-phenylureido group and a 5-acylamino group, as described in U.S. Pat. Nos. 3,446,622, 4,333,999, 4,451,559, and 4,427,767. In addition, naphthol cyan couplers having a sulfonamido or amido group in the 5-position of the naphthol nucleus, as described in Japanese patent application (OPI) Nos. 237448/85, 153640/86 and 145557/86 and European Pat. No. 161,626, can preferably be used in the present invention, to form color images of high fastness.

In order to correct unnecessary absorption of dyes formed from the magenta and cyan couplers in the short wavelength region, colored couplers are preferably used in color negative photographic materials for photographing. Typical examples of colored couplers are yellow colored magenta couplers as described in U.S. Pat. No. 4,163,670 and Japanese Patent Publication No. 39413/82; and magenta colored cyan couplers as described in U.S. Pat. Nos. 4,004,929 and 4,138,258 and British Pat. No. 1,146,368.

Couplers forming dyes with an appropriate diffusibility may be used to improve graininess. Regarding smearing couplers, examples of magenta couplers are described in U.S. Pat. No. 4,366,237 and British Pat. No. 2,125,570; and yellow, magenta or cyan couplers are described in European Pat. No. 96,570 and West German patent application (OLS) No. 3,234,533.

The dye forming couplers and the aforesaid special couplers may form dimers or higher polymers. Typical examples polymerized dye forming couplers in general are described in U.S. Pat. Nos. 3,451,820 and 4,080,211. Examples of polymerized magenta couplers are described in British Pat. No. 2,102,173, U.S. Pat. No. 4,367,282, Japanese patent application (OPI) No. 232455/86 and U.S. patent application Ser. No. 849,589 (filed Apr. 8, 1986) and 866,833 (filed May 27, 1986).

Regarding the incorporation of various kinds of couplers into the photographic materials in the present invention, two or more different kinds of couplers may be added to one light-sensitive layer, or the same coupler may be added to two or more different layers.

The compounds of the present invention may be used together with couplers, and may be added to the same emulsion layer together with the couplers, or may be added to intermediate layer(s) or other photographic auxiliary layer(s) in the form of an independent emulsified dispersion.

The amount of the present compounds used is about 0.1 to 50 mole %, preferably about 0.3 to 15 mole %, based on the coupler in each light-sensitive layer or the yellow coupler in the blue sensitive layer, the magenta coupler in the green-sensitive layer or the cyan coupler in the red-sensitive layer, in the color photographic material. The amount is preferably about $1\times10^{-5}$ mole to $8\times10^{-2}$ mole, especially about $1\times10^{-4}$ mole to $5\times10^{-2}$ mole, per mole of the silver halide in the layer to which the present compound is to be added.

In the case the silver halide photographic materials of the present invention are processed by a conventional wet method, any and every conventional method may be used. Known processing solutions may be used. The processing temperature is generally selected in the range of 18° C. to 50° C., but this may be lower than 18° C. or higher than 50° C. In accordance with the desired use of the photographic materials, any of black-and white photographic processing methods for the formation of silver images, or color photographic processing methods for the formation of color images may be applied to the materials.

Details of various useful photographic processing procedures are described in T. H. James, *The Theory of the Photographic Process,* pp. 291–436, 4th Ed. and *Research Disclosure,* Vol. 176, RD No. 17643 (Dec., 1978), pp. 28–30.

For fixing after black-and-white development, conventional fixers of general composition may be used.

The fixers may contain a thiosulfate or thiocyanate as a fixing agent or an organic sulfur containing compound which is known to be effective as a fixing agent. The fixer may contain a water-soluble aluminum salt as a hardener.

After color development, the photographic emulsion layers are generally bleached. The bleaching may be carried out simultaneously with fixing or separately therefrom.

As the bleaching agent there may be used polyvalent metal compounds such as iron(III), cobalt(III), chromium(VI) or copper(II) compounds, peracids, quinones or nitroso compounds. For instance, ferricyanides, bichromates and iron(III) or cobalt(III) organic complexes, for example, with an organic acid such as an aminopolycarboxylic acid (e.g., ethylenediaminetetraacetic acid, nitrilotriacetic acid, 1,3-diamino2-propanoltetraacetic acid), citric acid, tartaric acid or malic acid; persulfates and permanganates; and nitrosophenols, etc., may be used. In particular, potassium ferricyanide, sodium ethylenediaminetetraacetato ferrate and ammonium ethylenediaminetetraacetato ferrate are especially useful. Ethylenediaminetetraacetato ferrate complexes are useful either in an independent bleaching solution or in a combined bleach-fix bath.

The bleaching or bleach-fixing solution may contain various additives such as a bleach accelerator described in U.S. Pat. Nos. 3,042,520 and 3,241,966 and a thiol compound described in Japanese patent application (OPI) No. 65732/78.

The present invention is applicable to heat-developable photographic light-sensitive materials to obtain silver images as described, for example, in *Shashin Kogaku no Kiso* ("Fundamentals of Photographic Engineering"), Non-silver halide photography edition, pages 242 to 255, (Corona Co., Ltd., in Japan, 1982), *Eizo Joho* (Image Information), page 40 (April, 1978), *Neblett's Handbook of Photography and Reprography,* pages 32 to 33, (7th Ed., Van Nostrand Reinhold Company), U.S. Pat. Nos. 3,152,904, 3,301,678, 3,392,020 and 3,457,075, British Pat. Nos. 1,131,108 and 1,167,777; and *Research Disclosure,* RD-17029, pages 9 to 15 (June, 1978), etc.

Also, the present invention can be applied to heat-developable photographic light-sensitive materials for forming color images, for example, those described in U.S. Pat. Nos. 3,531,286 and 3,761,270, Belgian Pat. No. 802,519, *Research Disclosure,* Vol. 137, No. 13742, pages 31 to 32 (Sept., 1975) U.S. Pat. Nos. 4,021,240, 4,463,079, 4,474,867, 4,478,927, 4,507,380, 4,500,626 and 4,483,914, Japanese patent application (OPI) Nos. 149046/83, 149047/83, 152440/84, 154445/84, 165054/84, 180548/84, 168439/84, 174832/84, 174833/84, 174834/84 and 174835/84, U.S. Pat. No. 4,499,180, Japanese patent application (OPI) No. 116943/84, European Pat. No. 125,521, U.S. Pat. No. 4,499,172, Japanese patent application (OPI) Nos. 180537/84, 84640/86, 218443/84 and 238056/86, European Pat. No. 210,660 A, etc.

The compound according to the present invention may also be used in silver halide photographic materials for a so-called color diffusion transfer process, which are developed using a processing solution near room temperature. Such a color diffusion transfer process is described, for example, in Belgian Pat. No. 757,959, etc.

The present invention is now explained in greater detail with reference to the following examples, but the present invention is not to be construed as being limited thereto. Unless otherwise indicated, all parts, percents and ratios are by weight.

EXAMPLE 1

[Application to a black-and-white photographic light-sensitive material]

A silver halide emulsion composed of silver chlorobromide (silver bromide: 5 mol %, average grain size: 0.22 μm) containing $1\times10^{-5}$ mol of rhodium per mol of silver was prepared. The emulsion was divided into five parts, to each of which were added 2-hydroxy-4,6-dichloro-1,3,5-triazine sodium salt, as a hardener, and potassium polystyrenesulfonate, as a viscosity increasing agent and coated on a polyethyleneterephthalate film so as to provide a silver coating amount of 3.8 g/m$^2$. On the silver halide emulsion layer, an aqueous solution containing gelatin in an amount so as to provide a coating amount of 1 g/m$^2$, a mordant as shown in Table 1 below in an amount so as to provide a coating amount of 0.9 g/m$^2$ and a dye as shown in Table 1 below in an amount so as to provide a coating amount of 0.22 g/m$^2$ was coated to form a protective layer. The protective layer further contained sodium p-dodecylbenzenesulfonate, as a coating aid and the same viscosity increasing agent as used in the emulsion layer.

The samples thus-prepared were exposed using a printer (P-607 type manufactured by Dainippon Screen Co., Ltd.) through an optical wedge and then subjected to development processing using a developing solution LD-835 (manufactured by Fuji Photo Film Co., Ltd.).

The results obtained are shown in Table 1 below. The test methods for evaluating properties shown in Table 1 were as follows.

(1) Relative sensitivity: The reciprocal of the exposure amount required for obtaining a density of 1.5, the sensitivity of the sample not containing dye being taken as 100.

(2) Fog after irradiation with safe-light: Fog obtained by the development processing of the sample after being irradiated with a fading preventing fluorescent lamp FLR40SW-DL-X Nu/M (manufacturing by Toshiba Electric) at about 200 lux for 1 hour.

(3) Remainder color: Absorbance of λmax after the development processing.

TABLE 1

| Sample | Mordant | Dye | Relative(1) Sensitivity | Fog after Safe-(2) Light Irradiation | Remainder(3) Color |
|---|---|---|---|---|---|
| 101 | — | — | 100 | 1.95 | 0.00 |
| 102 (Present Invention) | Compound (2) | B | 67 | 0.17 | 0.02 |
| 103 (Present Invention) | Compound (6) | B | 69 | 0.15 | 0.02 |
| 104 (Comparison) | Comparative Compound (A) | B | 69 | 0.30 | 0.04 |
| 105 (Comparison) | — | B | 78 | 0.45 | 0.02 |

Comparative Compound (A):

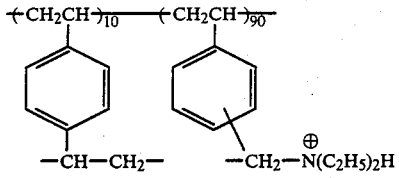

Dye B:

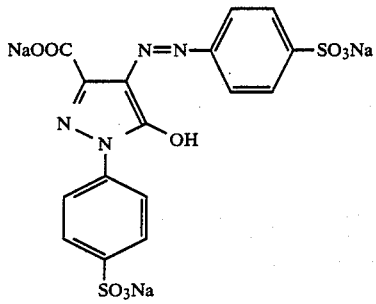

As is apprent from the results shown in Table 1, the compounds according to the present invention restrained adverse influences on the photographic emulsion, e.g., decrease in sensitivity, due to the dye and exhibited significantly improved safe-light stability and slight remainder color after processing in comparison with the comparative compound.

EXAMPLE 2

Sample 201

On a cellulose triacetate film support film support provided with a subbing layer was coated each layer having the composition set forth below to prepara a multilayer color photographic light-sensitive material which was designated as Sample 201.

With respect to the compositions of the layers, coated amounts of silver halide and colloidal silver are shown by g/m$^2$ units of silver, and the coated amounts of other additives are shown by g/m$^2$ units, except that the coated amount of a sensitizing dye (ExS) is shown as mol per mol of silver halide present in the same layer.

| | |
|---|---|
| First Layer: Antihalation Layer | |
| Black colloidal silver | 0.2 |
| Gelatin | 1.4 |
| UV-1 | 0.02 |
| UV-2 | 0.04 |
| UV-3 | 0.04 |
| Solv-1 | 0.05 |
| Second Layer: Intermediate Layer | |
| Fine grain silver bromide (average grain diameter: 0.07 μm) | 0.08 |
| Gelatin | 1.1 |
| ExC-1 | 0.02 |
| ExM-1 | 0.06 |
| UV-1 | 0.03 |
| UV-2 | 0.06 |
| UV-3 | 0.07 |
| Cpd-1 | 0.1 |
| ExF-1 | 0.004 |
| Solv-1 | 0.1 |
| Solv-2 | 0.09 |
| Third Layer: Low-Sensitive Red-Sensitive Emulsion Layer | |
| Silver iodobromide emulsion (AgI: 6.3 mol %, internal high AgI type, core/shell ratio of 1:1, diameter corresponding to sphere: 0.8 μm, coefficient of variation of diameter corresponding to sphere: 25%, tabular grain, diameter/thickness ratio: 2) | 1.5 (as silver) |
| Gelatin | 1.7 |
| ExC-2 | 0.3 |
| ExC-3 | 0.02 |
| ExS-1 | $7.1 \times 10^{-5}$ |
| ExS-2 | $1.9 \times 10^{-5}$ |
| ExS-3 | $2.4 \times 10^{-4}$ |
| ExS-4 | $4.2 \times 10^{-5}$ |
| Solv-2 | 0.03 |
| Fourth Layer: Medium-Sensitive Red-Sensitive Emulsion Layer | |
| Silver iodobromide emulsion (AgI: 4.8 mol %, internal high AgI type, core/shell ratio of 1:4, diameter corresponding to sphere: 0.9 μm, coefficient of variation of diameter corresponding to sphere: 50%, tabular grain, diameter/thickness ratio: 1.5) | 1.4 (as silver) |
| Gelatin | 2.1 |
| ExC-2 | 0.4 |
| ExC-3 | 0.002 |
| ExS-1 | $5.2 \times 10^{-5}$ |
| ExS-2 | $1.4 \times 10^{-5}$ |
| ExS-3 | $1.8 \times 10^{-4}$ |
| ExS-4 | $3.1 \times 10^{-5}$ |
| Solv-2 | 0.5 |
| Fifth Layer: High-Sensitive Red-sensitive Emulsion Layer | |
| Silver iodobromide emulsion (AgI: 10.2 mol %, internal high AgI type, core/shell ratio of 1:2, diameter corresponding to sphere: 1.2 μm, coefficient of variation of diameter corresponding to sphere: 35%, tabular grain, diameter/thickness ratio: 3.5) | 2.1 (as silver) |
| Gelatin | 2.0 |
| ExC-1 | 0.06 |
| ExC-4 | 0.04 |
| ExC-5 | 0.2 |
| ExS-1 | $6.5 \times 10^{-5}$ |
| ExS-2 | $1.7 \times 10^{-5}$ |
| ExS-3 | $2.2 \times 10^{-4}$ |
| ExS-4 | $3.8 \times 10^{-5}$ |
| Solv-1 | 0.1 |
| Solv-2 | 0.3 |
| Sixth Layer: Intermediate Layer | |
| Gelatin | 1.1 |
| Seventh Layer: Low-Sensitive Green-Sensitive Emulsion Layer | |
| Silver iodobromide emulsion (AgI: 6.3 mol %, internal high AgI type, core/shell ratio of 1:1, diameter corresponding to sphere: 0.8 μm, coefficient of variation of diameter corresponding to sphere: 25%, tabular grain, diameter/thickness ratio: 2) | 0.6 (as silver) |
| Gelatin | 0.8 |
| ExM-2 | 0.3 |
| ExM-1 | 0.03 |
| ExM-3 | 0.05 |
| ExY-1 | 0.04 |
| ExS-5 | $3.1 \times 10^{-5}$ |
| ExS-6 | $1.0 \times 10^{-4}$ |
| ExS-7 | $3.8 \times 10^{-4}$ |
| H-1 | 0.04 |
| H-2 | 0.01 |
| Solv-2 | 0.2 |
| Eighth Layer: Medium-Sensitive Green-Sensitive Emulsion Layer | |
| Silver iodobromide emulsion (AgI: 4.8 mol %, internal high AgI type, core/shell ratio of 1:4, diameter corresponding to sphere: 0.9 μm, coefficient of variation of diameter corresponding to sphere: 50%, tabular grain, diameter/thickness ratio: 1.5) | 1.1 (as silver) |
| Gelatin | 1.4 |
| ExM-4 | 0.2 |

-continued

| | |
|---|---|
| ExM-5 | 0.05 |
| ExM-1 | 0.01 |
| ExM-3 | 0.01 |
| ExY-1 | 0.02 |
| ExS-5 | $2.0 \times 10^{-5}$ |
| ExS-6 | $7.0 \times 10^{-5}$ |
| ExS-7 | $2.6 \times 10^{-4}$ |
| H-1 | 0.07 |
| H-2 | 0.02 |
| Solv-1 | 0.06 |
| Solv-2 | 0.4 |
| Ninth Layer: High-Sensitive Green-Sensitive Emulsion Layer | |
| Silver iodobromide emulsion (AgI: 10.2 mol %, internal high AgI type, core/shell ratio of 1:2, diameter corresponding to sphere: 1.2 μm, coefficient of variation of diameter corresponding to sphere: 38%, tabular grain, diameter/thickness ratio: 4) | 2.1 (as silver) |
| Gelatin | 2.2 |
| ExC-2 | 0.02 |
| ExM-5 | 0.1 |
| ExM-1 | 0.05 |
| ExS-5 | $3.5 \times 10^{-5}$ |
| ExS-6 | $8.0 \times 10^{-5}$ |
| ExS-7 | $3.0 \times 10^{-4}$ |
| Solv-1 | 0.08 |
| Solv-2 | 0.7 |
| Tenth Layer: Yellow Filter Layer | |
| Yellow colloidal silver | 0.05 |
| Gelatin | 1.0 |
| Cpd-1 | 0.1 |
| Eleventh Layer: Low-Sensitive Blue-Sensitive Emulsion Layer | |
| Silver iodobromide emulsion (AgI: 9.0 mol %, internal high AgI type, core/shell ratio of 1:2, diameter corresponding to sphere: 0.75 μm, coefficient of variation of diameter corresponding to sphere: 21%, octahedral grain, diameter/thickness ratio: 1) | 0.3 (as silver) |
| Gelatin | 1.3 |
| ExY-2 | 0.7 |
| ExY-1 | 0.03 |
| H-1 | 0.03 |
| H-2 | 0.01 |

-continued

| | |
|---|---|
| Solv-2 | 0.3 |
| Twelfth Layer: Medium-Sensitive Blue-Sensitive Emulsion Layer | |
| Silver iodobromide emulsion (AgI: 10.2 mol %, internal high AgI type, core/shell ratio of 1:2, diameter corresponding to sphere: 1.0 μm, coefficient of variation of diameter corresponding to sphere: 30%, tabular grain, diameter/thickness ratio: 3.5) | 0.4 (as silver) |
| Gelatin | 0.7 |
| ExY-2 | 0.1 |
| ExS-8 | $2.2 \times 10^{-4}$ |
| H-1 | 0.01 |
| H-2 | 0.005 |
| Solv-2 | 0.05 |
| Thirteenth Layer: High-Sensitive Blue-Sensitive Emulsion Layer | |
| Silver iodobromide emulsion (AgI: 9.8 mol %, internal high AgI type, core/shell ratio of 1:2, diameter corresponding to sphere: 1.8 μm, coefficient of variation of diameter corresponding to sphere: 55%, tabular grain, diameter/thickness ratio: 4.5) | 0.8 (as silver) |
| Gelatin | 0.7 |
| ExY-2 | 0.2 |
| ExS-8 | $2.3 \times 10^{-4}$ |
| Solv-2 | 0.07 |
| Fourteenth Layer: First Protective Layer | |
| Gelatin | 0.9 |
| UV-4 | 0.1 |
| UV-5 | 0.2 |
| H-1 | 0.02 |
| H-2 | 0.005 |
| Solv-3 | 0.03 |
| Cpd-2 | 0.7 |
| Fifteenth Layer: Second Protective Layer | |
| Fine grain silver bromide emulsion (average grain diameter: 0.07 μm) | 0.1 |
| Gelatin | 0.7 |
| H-1 | 0.2 |
| H-2 | 0.05 |

The compounds used for the preparation of Sample 201 are illustrated below.

ExS-1

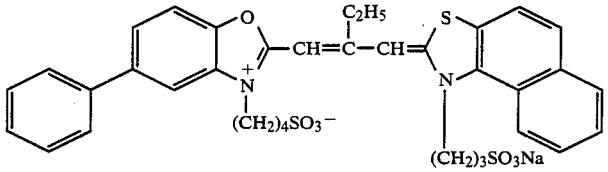

ExS-2

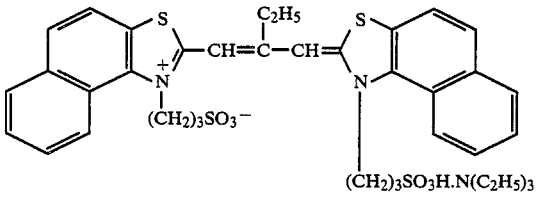

ExS-3

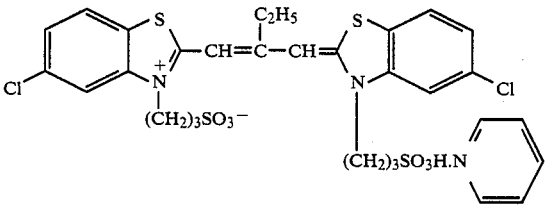

-continued
ExS-4
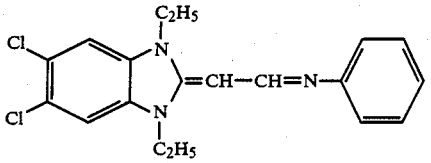
ExS-5
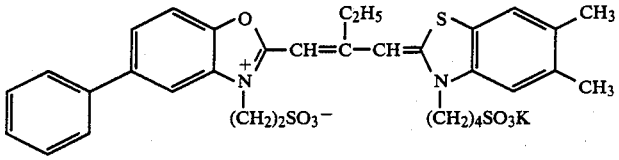
ExS-6
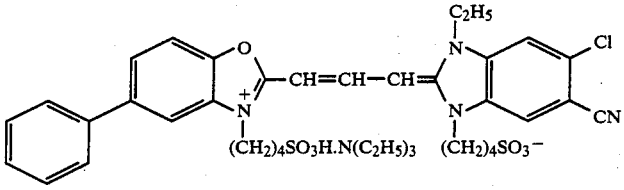
ExS-7
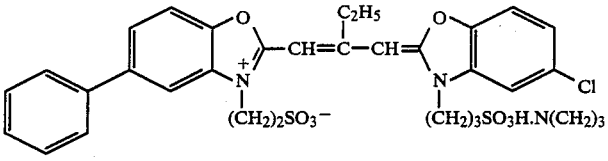
ExS-8
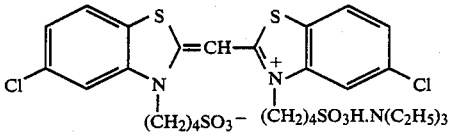
ExC-1
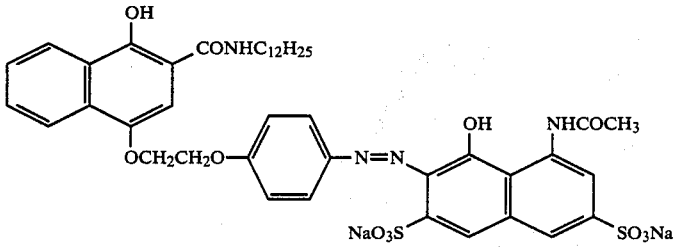
ExC-2
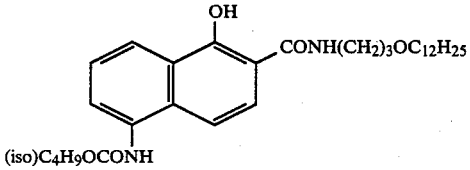
ExC-3
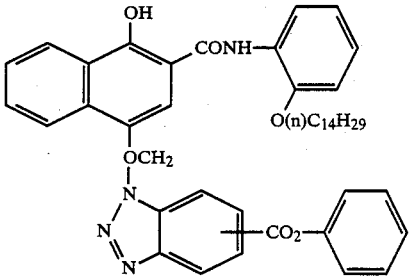

-continued
ExC-4
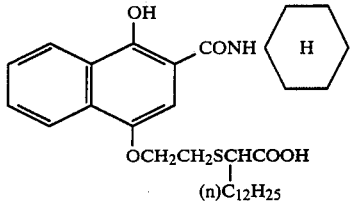
ExC-5
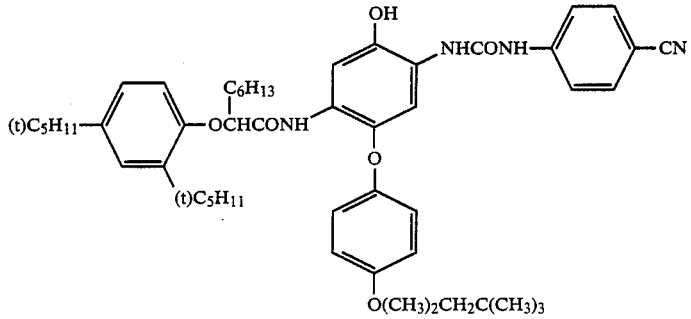
ExM-1
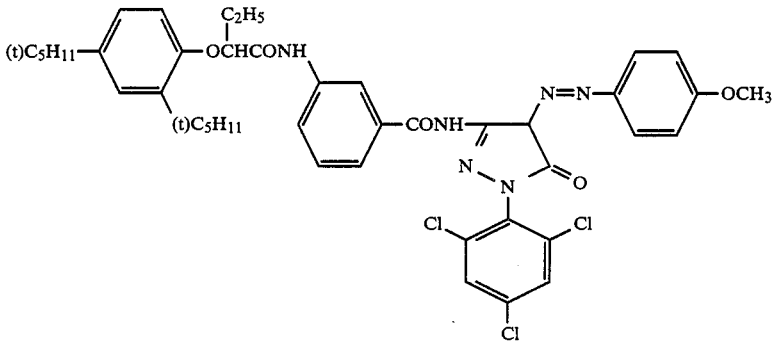
ExM-2
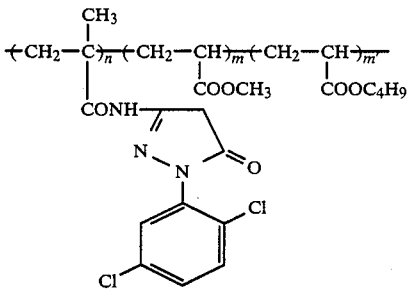
n/m + m' = 1
m/m' = 1
Molecular weight: about 40,000
ExM-3
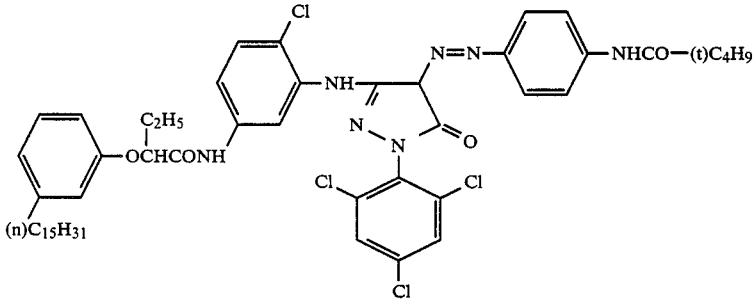

-continued
ExM-4
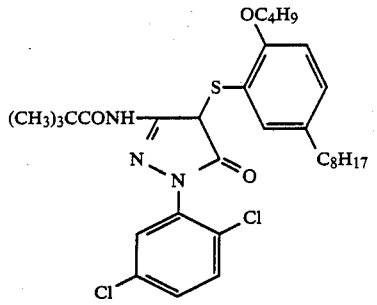
ExM-5
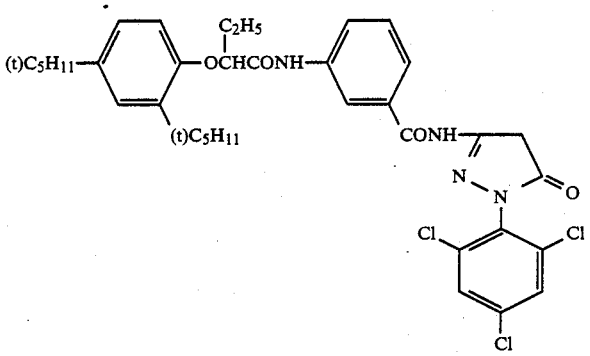
ExY-1
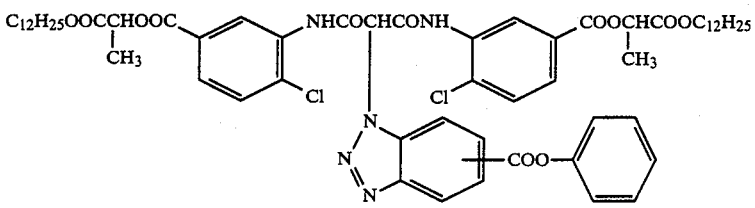
ExY-2
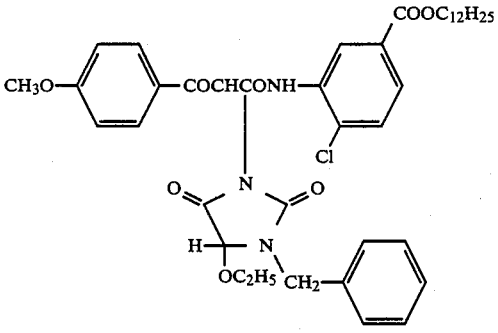
UV-1
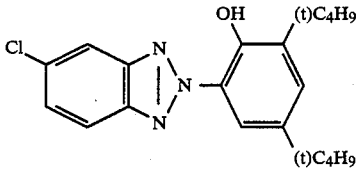
UV-2
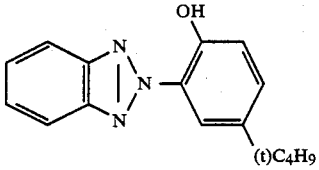

-continued

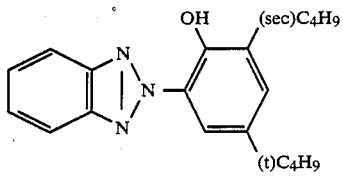

UV-3

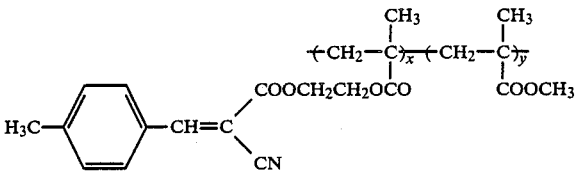

x/y = 7/3 (wt.)

UV-4

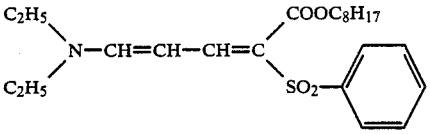

UV-5

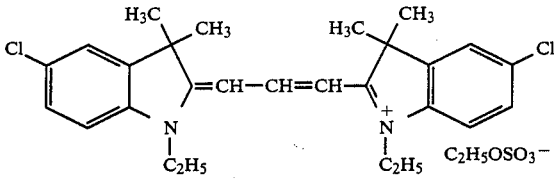

ExF-1

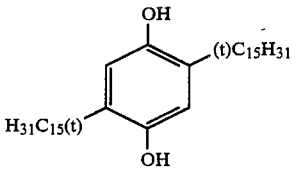

Cpd-1

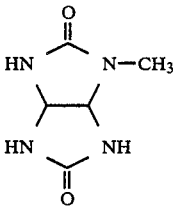

Cpd-2

Di-n-butyl phthalate — Solv-1
Tricresyl phosphate — Solv-2
Trihexyl phosphate — Solv-3

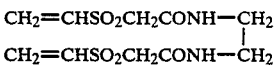

H-1

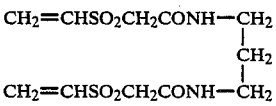

H-2

Sample 202

Sample 202 was prepared in the same manner as described for Sample 201, except that 0.2 g of Compound C for comparison was added in place of yellow colloidal silver to the tenth layer of Sample 201.

Samples 203 and 204

Samples 203 and 204 were prepared in the same manner as described for Samples 202, except that the compounds according to the present invention as shown in Table 2 below in an amount of 0.9 g/m$^2$, and Compound D in an equimolar amount to Compound C, were added in place of Compound C, and further S-46 according to the present invention in an amount of 0.3 g/m$^2$ as a reducing agent was used together with Cpd-1 in the tenth layer of Sample 202, respectively.

Samples 201 and 204 thus-prepared were subjected to wedge exposure to white light and then development processing described below.

| Processing Step | Processing Time | Processing Temperature |
|---|---|---|
| Color Development | 3 min. 15 sec. | 38° C. |
| Bleaching | 1 min. 00 sec. | 38° C. |
| Bleach-Fixing | 3 min. 15 sec. | 38° C. |
| Washing with Water (1) | 40 sec. | 35° C. |
| Washing with Water (2) | 1 min. 00 sec. | 35° C. |
| Stabilizing | 40 sec. | 38° C. |
| Drying | 1 min. 15 sec. | 55° C. |

The composition of each processing solution used is illustrated below.

| | |
|---|---|
| Color Developing Solution: | |
| Diethylenetriaminepentaacetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-(N—ethyl-N—β-hydroxyethylamino)-2-methylaniline sulfate | 4.5 g |
| Water to make | 1.0 l |
| pH | 10.05 |
| Bleaching Solution: | |
| Ammonium ethylenediaminetetraacetato ferrate dihydrate | 120.0 g |
| Disodium ethylenediaminetetraacetate | 10.0 g |
| Ammonium bromide | 100.0 g |
| Ammonium nitrate | 10.0 g |
| Bleach accelerating agent: | 0.005 mol |

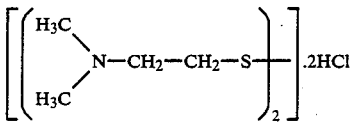

| | |
|---|---|
| Aqueous ammonia (27%) | 15.0 ml |
| Water to make | 1.0 l |
| pH | 6.3 |
| Bleach-Fixing Solution: | |
| Ammonium ethylenediaminetetraacetato ferrate dihydrate | 50.0 g |
| Disodium ethylenediaminetetraacetate | 5.0 g |
| Sodium sulfite | 12.0 g |
| Aqueous solution of ammonium thiosulfate (70%) | 240.0 ml |
| Aqueous ammonia (27%) | 6.0 ml |
| Water to make | 1.0 l |
| pH | 7.2 |

Washing Water

City water was passed through a mixed bed type column filled with an H type strong acidic cation exchange resin (Amberlite IR-120B manufactured by Rohm & Haas Co.) and an OH type anion exchange resin (Amberlite IR-400 manufactured by Rohm & Haas Co.) to reduce both calcium ions and magnesium ions to concentrations of not more than 3 mg per liter respectively, and then were added sodium dichloroisocyanurate in an amount of 20 mg per liter and sodium sulfate in an amount of 150 mg per liter thereto. The pH of the washing water was in a range of 6.5 to 7.5.

| | |
|---|---|
| Stabilizing Solution: | |
| Formalin (37%) | 2.0 ml |
| Polyoxyethylene-p-monononyl phenyl ether (average degree of polymerization: 10) | 0.3 g |
| Disodium ethylenediaminetetraacetate | 0.05 g |

-continued

| | |
|---|---|
| Stabilizing Solution: | |
| Water to make | 1.0 l |
| | pH 5.8 to 8.0 |

Yellow and magenta densities of the samples thus-processed were measured. The results obtained are shown in Table 2 below.

TABLE 2

| Sample | Compound | Sensitivity of[1] Green-Sensitive Layer | Dmin of[2] Yellow Color Image |
|---|---|---|---|
| 201 (Comparison) | — | ±0 | ±0 |
| 202 (Comparison) | Compound C | +0.09 | +0.10 |
| 203 (Present Invention) | Compound (2) Compound D | +0.11 | +0.01 |
| 204 (Present Invention) | Compound (5) Compound D | +0.09 | +0.01 |

[1]Log E required for obtaining a density of fog +0.15 is shown relatively.
[2]The difference from Sample 201 is shown.

Compound C:

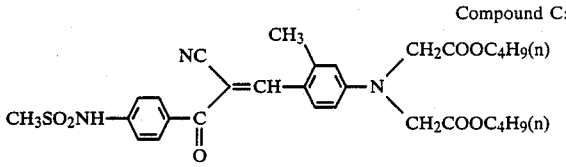

Compound D:

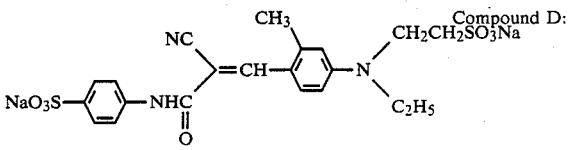

EXAMPLE 3

Preparation of Tabular Silver Iodobromide Grain Emulsion:

30 g of gelatin and 6 g of potassium bromide were added to 1 liter of water, and the solution was maintained at 60° C. in a container, to which were added with stirring an aqueous solution containing 5 g of silver nitrate and an aqueous solution of potassium bromide containing 0.15 g of potassium iodide over a period of 1 minute according to a double jet process. Further, an aqueous solution containing 145 g of silver nitrate and an aqueous solution of potassium bromide containing 4.2 g of potassium iodide were added thereto according to a double jet process. The speed of current was adjusted so that the speed of current at the end of the addition became 5 times the speed of current at the initiation of the addition. After the completion of the addition, the water-soluble salts were removed from the emulsion at 35° C. by a flocculation method. The resulting emulsion was heated to 40° C., to which was further added 75 g of gelatin, followed by adjusting the pH to 6.7. The emulsion thus-obtained contained tabular grains having a diameter (of projected area) of 0.98 μm, an average thickness of 0.138 μm and a silver iodide content of 3 mol %. The emulsion was subjected to chemical sensitization using gold sensitization and sulfur sensitization in combination and then 500 mg of sodium salt of anhydro-5,5'-dichloro-9-ethyl-3,3'-di(3-sulfopropyl)oxacarbocyanine hydroxide and 200 mg of potassium iodide were added thereto per mol of silver.

Preparation of Photographic Materials 301 and 305

An aqueous gelatin solution containing polymethyl methacrylate fine particles (average particle size: 3.0 μm), polyethylene oxide, etc. was prepared for a coating solution of a surface protective layer.

To the above-described emulsion were added, as stabilizers, 4-hydroxy-6-methyl-1,3,3a,7-tetrazaindene, 2,6-bis(hydroxyamino)-4-diethylamino-1,3,5-triazine and nitron, as a dry fog preventing agent, trimethylolpropane, a coating aid and a hardener to prepare a coating solution.

On both surfaces of a polyethylene terephthalate film support, the coating solutions of protective layer and emulsion layer were simultaneously coated and dried to prepare a photographic material.

With respect to Photographic Materials 301, 302 and 303, a coating amount of gelatin in the protective layer was changed, and with respect to Photographic Materials 304 and 305, a part of the gelatin was replaced with Compound 13 according to the present invention. The coating amounts are described in Table 3 below. As the hardener, 1,2-bis(vinylsulfonylacetamido)ethane was used in the surface protective layer and the silver halide emulsion layer in an amount of 12 mmol per 100 g of gelatin.

Development Processing

The compositions of concentrated solutions for a developing solution and a fixing solution were as follows.

| | |
|---|---|
| Concentrated Solution for Developing Solution: | |
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydroquinone | 83.3 g |
| Diethylene glycol | 40 g |
| 4-Hydroxymethyl-4-methyl-1-phenyl-3-pyrazolidone | 11.00 g |
| 5-Methylbenzotriazole | 2 g |
| Water to make | 1 l |
| pH was adjusted to 10.60. | |
| Concentrated Solution for Fixing Solution: | |
| Ammonium thiosulfate | 560 g |
| Sodium sulfite | 60 g |
| Disodium ethylenediaminetetraacetate dihydrate | 0.10 g |
| Sodium hydroxide | 24 g |
| Water to make | 1 l |
| pH was adjusted to 5.10 with acetic acid. | |

At the time of initiation of the development processing, the tanks were filled with the processing solutions described below respectively.

Development Tank

To a mixture of 333 ml of the above-described concentrated solution for developing solution and 667 ml of water, was added 10 ml of a starter containing 2 g of potassium bromide and 1.8 g of acetic acid to adjust the pH to 10.15.

Fixing Tank

A mixture of 250 ml of the above-described concentrated solution for fixing solution and 750 ml of water.

The temperature and time of each processing step were as follows.

| | |
|---|---|
| Development | 35° C. × 12.5 sec |
| Fixing | 35° C. × 12.5 sec |
| Washing with Water | 20° C. × 7.5 sec |
| Drying | 60° C. |
| Processing time for Dry to Dry | 50 sec |

Evaluation of Photographic Property

The photographic materials were subjected to automatic development processing using the processing solutions described above. The exposure was performed using tungsten light passed through a filter which cut light having wavelength of 480 nm or shorter. The sensitivity is shown relatively using a reciprocal of the exposure amount required for obtaining a density of fog+0.5.

Further, the samples were treated through the development-fixing-water washing steps of automatic development processing using the above-described developing solution and fixing solution, picked up just before the drying zone and then subjected to the following measurement. Specifically, the sample film was blown with warm air using a commercially available dryer and the time required for decreasing temperature of the surface of the sample film to 30° C. by a surface thermometer was measured. During the measurement, the drying current was stopped. The developing temperature was 35° C., and the temperature of washing water was 14° C.

Moreover, the scratch strength of the surface protective layer was qualitatively determined.

The results thus-obtained are shown in Table 3 below.

TABLE 3

| Photographic Material | Protective Layer: Coating Amount of Gelatin ($g/m^2$ of one surface) | Protective Layer: Coating Amount of Compound 13 ($g/m^2$ of one surface) | Sensitivity | Time for Drying (sec) | Scratch Strength of surface Protective Layer |
|---|---|---|---|---|---|
| 1 | 1.6 | — | 100 | 25 | Excellent |
| 2 | 1.3 | — | 105 | 23 | Excellent |
| 3 | 0.8 | — | 112 | 20 | Poor |
| 4 (Present Invention) | 0.8 | 0.5 | 110 | 20 | Good |
| 5 (Present | 0.8 | 0.8 | 120 | 22 | Excellent |

TABLE 3-continued

| Photographic Material | Protective Layer: Coating Amount of Gelatin ($g/m^2$ of one surface) | Protective Layer: Coating Amount of Compound 13 ($g/m^2$ of one surface) | Sensitivity | Time for Drying (sec) | Scratch Strength of surface Protective Layer |
|---|---|---|---|---|---|
| Invention) | | | | | |

From the results shown in Table 3 it can be seen that the photographic materials containing the compound according to the present invention had high sensitivity and exhibited a short drying time and a high layer scratch strength of the surface protective layer.

EXAMPLE 4

A silver halide emulsion was prepared in the following manner.

To an aqueous gelatin solution prepared by dissolving 20 g of gelatin and ammonium in 1000 ml of water and maintained at 50° C. were added simultaneously 1000 ml of an aqueous solution potassium idodide and potassium bromide and an aqueous solution of silver nitrate prepared by dissolving 1 mole of silver nitrate in 1000 ml of water maintaining pAg constant. Thus, a monodisperse octahedral silver iodobromide emulsion (iodide content: 5 mol %, average particle size: 0.5 μm) was obtained.

After washing with water and desalting of the emulsion, 5 mg of chloroauric acid (tetrahydrate) and 2 mg of sodium thiosulfate were added thereto and subjected to gold sensitization and sulfur sensitization at 60° C. The yield of the emulsion was 1.0 kg.

A light-sensitive material having the following layer composition was prepared.

Support

Polyethylene terephthalate (thickness 100 μm)

| | |
|---|---|
| First Layer: | |
| Silver iodobromide emulsion described above (iodide content: 5 mol %) | 600 $mg/m^2$ (as silver) |
| Compound (6) of the present invention | 800 $mg/m^2$ |
| 2,5-Dioctylhydroquinone | 300 $mg/m^2$ |
| 1,5-Diphenyl-3-pyrazolidone | 40 $mg/m^2$ |
| Tricyclohexyl phosphate | 300 $mg/m^2$ |
| Surface active agent | 80 $mg/m^2$ |
| $C_9H_{19}$— 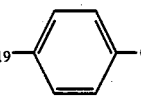 —$O(CH_2CH_2O)_8H$ | |
| Gelatin | 1200 $mg/m^2$ |
| Second Layer: | |
| Gelatin | 800 $mg/m^2$ |
| Hardener [1,2-bis(vinylsulfonyl-acetamido)ethane] | 100 $mg/m^2$ |
| Silica (particle size: 4 μm) | 100 $mg/m^2$ |
| Zinc hydroxide (particle size: 0.2 μm) | 400 $mg/m^2$ |

A dye sheet was prepared in the following manner.

60 g of gelatin, 80 g of guanidine picolinate and 2.5 g of sodium copper phthalocyaninetetrasulfonate were dissolved in 1300 ml of water, and the resulting solution was coated on a polyethylene laminated paper support to form a layer having a wet layer thickness of 40 μm and dried.

The above-described light-sensitive material was imagewise exposed to white light at 2000 lux for 2 seconds. On the emulsion side of the exposed light-sensitive material was coated 20 $ml/m^2$ of water using a wire bar. It was superimposed on the above-described dye sheet, and then heated for 20 seconds by means of passing through heat rollers heated at 90° C. The light-sensitive material was peeled off and washed with water to obtain a dark blue positive image. The material was further treated with a fixing solution containing ammonium thiosulfate and then washed with water to obtain a clear blue positive image having a good S/N ratio. The maximum density ($D_{max}$) and the minimum density ($D_{min}$) at 660 nm was measured to obtain the following results.

| | |
|---|---|
| $D_{max}$ | 1.58 |
| $D_{min}$ | 0.24 |

A light-sensitive material having the following layer composition was prepared.

Support

Polyethylene terephthalate (thickness 100 μm)

| | |
|---|---|
| First Layer: | |
| Silver iodobromide emulsion (same as described in Example 4) | 570 $mg/m^2$ (as silver) |
| Compound (22) of the present invention | 1000 $mg/m^2$ |
| Polyvinyl imidazole | 300 $mg/m^2$ |
| 2,5-Dioctylhydroquinone | 280 $mg/m^2$ |
| 1,5-Diphenyl-3-pyrazolidone | 35 $mg/m^2$ |
| Trimethylolpropanetriacrylate | 1200 $mg/m^2$ |
| Surface active agent | 100 $mg/m^2$ |
| $C_9H_{19}$— 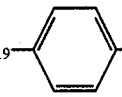 —$O(CH_2CH_2O)_8H$ | |
| Gelatin | 1200 $mg/m^2$ |
| Second Layer: | |
| Gelatin | 800 $mg/m^2$ |
| Hardener [1,2-bis(vinylsulfonyl-acetamido)ethane] | 100 $mg/m^2$ |
| Silica (particle size: 4 μm) | 100 $mg/m^2$ |
| Zinc hydroxide (particle size: 0.2 μm) | 400 $mg/m^2$ |

A dye sheet was prepared in the same manner as described in Example 4.

The above-described light-sensitive material was imagewise exposed to white light at 2000 lux for 2 seconds. On the emulsion side of the exposed light-sensitive material was coated 20 $ml/m^2$ of water using a wire bar. It was superimposed on the above-described dye sheet, and then heated for 25 seconds by means of passing through heat rollers heated at 85° C. The light-sensitive material was peeled off, immersed into warm water at 50° C. and the unhardened portion was washed off, whereby a clear blue negative image was obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, at least one layer of said silver halide photographic material comprising at least one compound represented by formula (I):

$$PWR\text{-}(\text{Time}_t)\text{-}POL \qquad (I)$$

wherein PWR represents a group capable of releasing Time—$_t$POL upon reduction; Time represents a divalent organic group capable of releasing POL via a subsequent reaction after (Time$_t$POL is released from PWR; t is 0 or 1; and POL represents a polymer group.

2. The silver halide photographic material as claimed in claim 1, wherein the compound represented by formula (I) is a compound represented by formula (II):

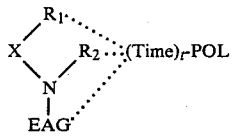

(II)

wherein EAG represents an electron accepting group; N represents a nitrogen atom; X represents an oxygen atom (—O—), a sulfur atom (—S—) or an atomic group containing a nitrogen atom

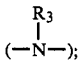

$R_1$, $R_2$ and $R_3$, which may be the same or different, each represents a chemical bond or a group other than a hydrogen atom, or $R_1$, $R_2$, $R_3$ and EAG may be connected with each other to form a ring; Time represents a group capable of releasing POL via a subsequent reaction triggered by the cleavage of the N-X bond in the compound; t represents 0 1, when t represents 0, Time represents a chemical bond; the solid lines each represents a bond; the dotted lines mean that at least one of the dotted lines is a bond; and POL and t each has the same meaning as defined in formula (I).

3. The silver halide photographic material as claimed in claim 2, wherein $R_1$ and $R_3$ each represents a substituted or unsubstituted alkyl group, a substituted or unsubstituted aralkyl group, a substituted or unsubstituted alkenyl group, a substituted or unsubstituted alkynyl group, a substituted or unsubstituted aryl group, a substituted or unsubstituted heterocyclic group, a substituted or unsubstituted acyl group, or a substituted or unsubstituted sulfonyl group; $R_2$ represents a substituted or unsubstituted acyl group or a substituted or unsubstituted sulfonyl group, and X represents an oxygen atom.

4. The silver halide photographic material as claimed in claim 2, wherein the compound represented by formula (II) is a compound represented by formula (III):

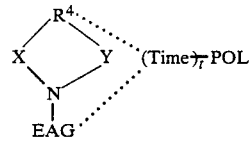

(III)

wherein Y represents a divalent linking group; $R_4$ represents an atomic group necessary for forming a 5-membered to 8-membered monocyclic or condensed heterocyclic ring together with

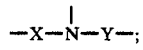

and N, X, EAG, Time, t, POL and the dotted lines each has the same meaning as in formula (II).

5. The silver halide photographic material as claimed in claim 4, wherein X represents an oxygen atom.

6. The silver halide photographic material as claimed in claim 4, wherein the divalent linking group represented by Y is

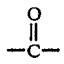

or $—SO_2—$.

7. The silver halide photographic material as claimed in claim 2, wherein EAG is represented by formula (A):

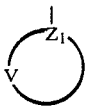

(A)

wherein $Z_1$ represents

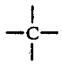

Sub or a nitrogen atom; and V represents an atomic group necessary for forming a 3-membered to 8-membered aromatic ring containing members selected from

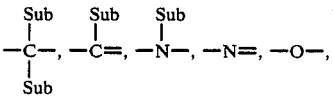

—S—and $—So_2—$, wherein plural Sub groups may be the same or different, each Sub group represents a hydrogen atom or a substituent, and at least two Sub groups may be linked to form a 3-membered to 8-membered saturated or unsaturated carbocyclic ring or a 3-membered to 8-membered saturated or unsaturated heterocyclic ring; provided that the sum of the Hammett's sigma constants and Hammett's para constants of said Sub groups is at least +0.50.

8. The silver halide photographic material as claimed in claim 1, wherein said polymer group represented by POL has an average molecular weight of at least about 1,500.

9. The silver halide photographic material as claimed in claim 1, wherein said polymer group represented by POL is a photographically useful compound selected from the group consisting of a development inhibitor, a development accelerator, a nucleating agent, a coupler, a desilvering accelerator, a desilvering inhibitor, a silver halide solvent, a developer, a fixing accelerator, a fixing inhibitor, a silver image stabilizer, a toning agent, a color image stabilizer, a light filter, an antihalation agent, a hardener, a desensitizer, a contrast intensifiers, a chelating agent, a mordanting agent, an antistain agent, a brightening agent, an ultraviolet absorbent, and a nucleation accelerator.

10. The silver halide photographic material as claimed in claim 1, wherein said polymer group represented by POL is a vinyl polymer group comprising a repeating unit represented by formula (X):

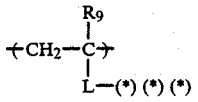

(X)

wherein $R_9$ represents a hydrogen atom or a lower alkyl group; L represents a chemical bond or a divalent linking group; and (*)(*)(*) indicates the position at which the group is bonded to $Time_t$PWR.

11. The silver halide photographic material as claimed in claim 10, wherein said divalent linking group represented by L is a group represented by formula (L-1) or (L-2):

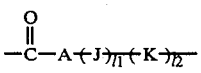

(L-1)

-continued

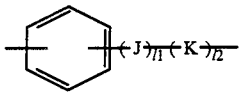

(L-2)

wherein A represents —O— or

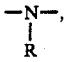

wherein R represents a hydrogen atom or a lower alkyl group; J represents an alkylene group or an arylene group; K represents —COO—, —OCO—, —CONH—, —NHCO—, —$SO_2$NH— or —NH$SO_2$—; and $l_1$ and $l_2$ each is 0 and 1.

12. The silver halide photographic material as claimed in claim 1, wherein said compound represented by formula (I) is present in a light-sensitive silver halide emulsion layer or one of the other constituting layers.

13. The silver halide photographic material as claimed in claim 1, wherein said compound represented by formula (I) is present in an amount of from about 10 mg to 10 g/$m^2$ of the support.

14. The silver halide photographic material as claimed in claim 1, wherein said silver halide photographic material further comprises a reducing substance.

15. The silver halide photographic material as claimed in claim 14, wherein said reducing substance is a diffusion-resistant reducing substance.

16. The silver halide photographic material as claimed in claim 15, wherein said silver halide photographic material further comprises an electron transfer agent.

17. The silver halide photographic material as claimed in claim 15, wherein said diffusion-resistant reducing substance comprises a hydroquinone, an aminophenol, an aminonaphthol, a 3-pyrazolidinone, saccharin or a picolinium compound.

18. The silver halide photographic material as claimed in claim 16, wherein said electron transfer agent is selected from a 3-pyrazolidinone, an aminophenol, a phenylenediamine and a reductone, each of which is diffusible.

* * * * *